US009132674B2

(12) United States Patent
Nagaoka

(10) Patent No.: US 9,132,674 B2
(45) Date of Patent: Sep. 15, 2015

(54) PRINTER AND CONTROL METHOD OF A PRINTER

(71) Applicant: Seiko Epson Corporation, Tokyo (JP)

(72) Inventor: Minoru Nagaoka, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,812

(22) Filed: Sep. 15, 2014

(65) Prior Publication Data

US 2015/0091966 A1 Apr. 2, 2015

(30) Foreign Application Priority Data

Sep. 27, 2013 (JP) ..... 2013-201141
Feb. 14, 2014 (JP) ..... 2014-026367

(51) Int. Cl.

| | |
|---|---|
| ***B41J 29/38*** | (2006.01) |
| ***B41J 15/00*** | (2006.01) |
| ***B41J 11/00*** | (2006.01) |
| ***B41J 15/04*** | (2006.01) |
| *B41J 3/407* | (2006.01) |

(52) U.S. Cl.

CPC ..... *B41J 15/00* (2013.01); *B41J 11/0075* (2013.01); *B41J 11/0095* (2013.01); *B41J 15/04* (2013.01); *B41J 3/4075* (2013.01)

(58) Field of Classification Search

CPC ..... B41J 15/00; B41J 3/4075; B41J 13/0009
See application file for complete search history.

(56) References Cited

U.S. PATENT DOCUMENTS

2014/0112695 A1* 4/2014 van Dijk et al. ..... 400/621

FOREIGN PATENT DOCUMENTS

| | | | |
|---|---|---|---|
| JP | 2003-048364 | A | 2/2003 |
| JP | 2004-358794 | A | 12/2004 |
| JP | 2007-302464 | A | 11/2007 |
| JP | 2008-114433 | A | 5/2008 |

* cited by examiner

*Primary Examiner* — Julian Huffman

(57) ABSTRACT

Waste of time and consumables is reduced and efficiency is improved by printing to near the end of the medium in a device that prints on media. A printer 1 has a conveyance unit that conveys label paper 100 with one or more labels 103, a printhead 40 disposed to the conveyance path 110, and a paper detector 61 and label detector 63. When the trailing end of the label paper 100 is detected, the printer 1 identifies the position of the trailing end of the label paper 100, and determines if printing on the label 103 can be completed based on the identified position of the trailing end of the label paper 100. If printing cannot be completed, printing by the printhead 40 stops or the label paper 100 is conveyed without printing on the label 103.

10 Claims, 13 Drawing Sheets

PRINTER AND CONTROL METHOD OF A PRINTER

Priority is claimed under 35 U.S.C. §119 from Japanese patent application nos. JP 2013-201141 filed on Sep. 27, 2013 and JP 2014-026367 filed on Feb. 14, 2014, which are hereby incorporated by reference in their entirety.

BACKGROUND

1. Technical Field

The present disclosure relates to a printer and a control method of a printer.

2. Related Art

Devices for detecting the trailing end of the medium in printers that print on continuous media, such as recording media having labels affixed to a rolled backer, are known from the literature. See, for example, JP-A-2003-48364.

A printer generally has a mechanism that holds and conveys the medium with conveyance rollers, for example, in order to stably convey the medium through the printer. When such conveyance rollers are used and the rollers become unable to hold the medium near the trailing end, the desired conveyance speed cannot be maintained, the medium cannot be printed normally, and images printed near the end of the medium may not be printed correctly. When printing on a medium carrying labels, for example, one or more labels closest to the trailing end of the medium may be printed incorrectly, and those labels are then thrown away. The label or page near the trailing end of the medium can be simply thrown away when the print image is misprinted, but reducing the waste of time, ink, and other consumables required to print the label or page that is discarded is desirable.

SUMMARY

At least one embodiment of the present invention enables improving efficiency and reducing the waste of time and consumables resulting from printing near the trailing end of the print medium in a device that prints on media.

One aspect of at least one embodiment of the present invention is a printer including: a conveyance mechanism that conveys a print medium having print targets; a printhead disposed to the conveyance path of the print medium; a detection unit that detects at plural detection positions on the conveyance path; and a control unit that identifies the position of the trailing end of the print medium when the trailing end of the print medium is detected by the detection unit, determines if printing on the print target can be completed based on the identified position of the trailing end of the print medium, and if printing cannot be completed, stopping printing by the printhead or conveying the print medium without printing on the print target.

Because this aspect of the invention detects the trailing end of the print medium on the conveyance path of the print medium, and stops unnecessary printing or does not print when printing on the print target cannot be completed, wasting consumables such as ink and the time required for printing can be eliminated.

Preferably, the printer also has a first detection unit that detects the trailing end of the print medium on the conveyance path of the print medium, and a second detection unit that detects the print targets. The control unit determines whether or not printing the print target detected by the second detection unit can be completed based on the position of the trailing end of the print medium detected by the first detection unit, and interrupts or avoids printing on the print target when printing cannot be completed.

Because this configuration stops or avoids printing when printing on the print target cannot be completed, unnecessary printing operations can be suppressed, and wasting the consumables and time required for printing can be eliminated.

Further preferably in a printer according to another aspect of at least one embodiment of the present invention, after the trailing end of the print medium is detected by the first detection unit, the control unit determines whether or not printing can be completed on the print target detected by the second detection unit before the trailing end of the print medium was detected by the first detection unit.

This configuration can determine if it is possible to finish printing a print target that passed the detection position of the second detection unit before the trailing end of the print medium was detected by the first detection unit. As a result, unnecessary printing operations can be suppressed, and waste of consumables and time can be eliminated.

In a printer according to another aspect of at least one embodiment of the present invention, a plurality of print targets of a specific length are disposed to the print medium in the conveyance direction; and the control unit does not determine the printability of a print target on the upstream side of a print target determined to be not completely printable.

When there is a print target that cannot be printed completely, this configuration does not evaluate the printability of print targets intended for printing after the print target that cannot be printed completely, and can quickly execute an operation other than printing. As a result, the print medium can be efficiently processed, including quickly discharging the print medium, when there is a print target that cannot be printed normally.

In a printer according to another aspect of at least one embodiment of the present invention, in the process of determining if printing on the print target can be completed, the control unit determines based on the position of the trailing end of the print target detected by the first detection unit if conveyance of the print medium is possible until printing on the print target is completed.

This configuration enable appropriately determining whether or not printing on a print target can be completed.

Further preferably in a printer according to another aspect of at least one embodiment of the present invention, the control unit decides based on a setting of the remaining length of the print medium required to convey the print medium until printing on the print target is completed.

Based on a preset value, this configuration enables appropriately determining whether or not printing on a print target can be completed.

Yet further preferably in a printer according to another aspect of at least one embodiment of the present invention, a recovery device that recovers the print medium after printing can be installed downstream from the printhead on the conveyance path; and the control unit decides based on the setting of the remaining length of print medium corresponding to whether or not the recovery device is installed.

This configuration enables determining if printing on the print target can be completed appropriately to whether or not the recovery device is used.

In a printer according to another aspect of at least one embodiment of the present invention, a plurality of print targets of a specific length are disposed to the print medium in the conveyance direction; and the control unit determines whether or not printing on the print target can be completed based on the detection result from the detection unit when the trailing end of the print medium is detected based on the detection result from the detection unit.

When printing cannot be completed on one of plural print targets disposed to the print medium in the conveyance direction, this configuration stops unnecessary printing or does not print on the print target, and wasting the ink and other consumables and time required for printing can be eliminated.

Further preferably in a printer according to another aspect of at least one embodiment of the present invention, the control unit determines at least whether or not printing can be completed on the print target closest to the trailing end of the print medium.

When printing on the print target closest to the trailing end of the print medium cannot be completed, this configuration stops unnecessary printing or does not print on that print target, and wasting the ink and other consumables and time required for printing can be eliminated.

In a printer according to another aspect of at least one embodiment of the present invention, the control unit determines whether or not printing can be completed by determining based on the position of the trailing end of the print medium detected by the detection unit whether or not the print medium can be conveyed until printing the print target is completed.

Based on whether or not the print medium can be conveyed until printing ends, this configuration can appropriately determine whether or not printing can be completed, and can eliminate unnecessary printing operations.

In a printer according to another aspect of at least one embodiment of the present invention, the detection unit has a plurality of detectors that detect the print medium at different positions in the conveyance direction of the print medium upstream from the printhead.

This configuration enables using plural detectors to detect the trailing end of the print medium and the leading ends of the print targets, and can therefore more appropriately determine if printing on a print target can be completed.

In a printer according to another aspect of at least one embodiment of the present invention, the detection unit detects a mark indicating the leading end of the print target or the position of the print target; and the control unit identifies the position of the leading end of the print target based on the detection result from the detection unit, and determines if printing can be completed based on the position of the leading end of the identified print target and the length of the print target in the conveyance direction.

This configuration can accurately identify the position of a print target by detecting the leading end of the print target or a mark, and can more appropriately determine if printing on the print target can be completed.

Another aspect of at least one embodiment of the present invention is a control method of a printer having a conveyance mechanism that conveys a print medium having print targets, and a printhead disposed to the conveyance path of the print medium, the control method including: determining if printing on the print target can be completed when the trailing end of the print medium is detected by detection at plural detection positions on the conveyance path, and if printing cannot be completed, stopping printing by the printhead or conveying the print medium without printing on the print target.

This aspect of the invention can eliminate wasting the ink and other consumables and time required for printing because it stops unnecessary printing or does not print when printing on a print target cannot be completed.

Another aspect of at least one embodiment of the present invention is a control method of a printer, including: detecting a print target and the trailing end of the print medium on the conveyance path of the print medium when conveying and printing on a print medium having a print target; determining whether or not printing on the detected print target can be completed based on the position of the detected trailing end of the print medium; and when printing cannot be completed, stopping or avoiding printing on the print target.

This aspect of the invention can suppress unnecessary printing operations and eliminate waste of consumables and time required for printing because printing is stopped or avoided when printing on a print target cannot be completed.

Other objects and attainments together with a fuller understanding of the invention will become apparent and appreciated by referring to the following description and claims taken in conjunction with the accompanying drawings.

DESCRIPTION OF EMBODIMENTS

Some embodiments of the present invention are described below with reference to the accompanying figures.

Figure 1:
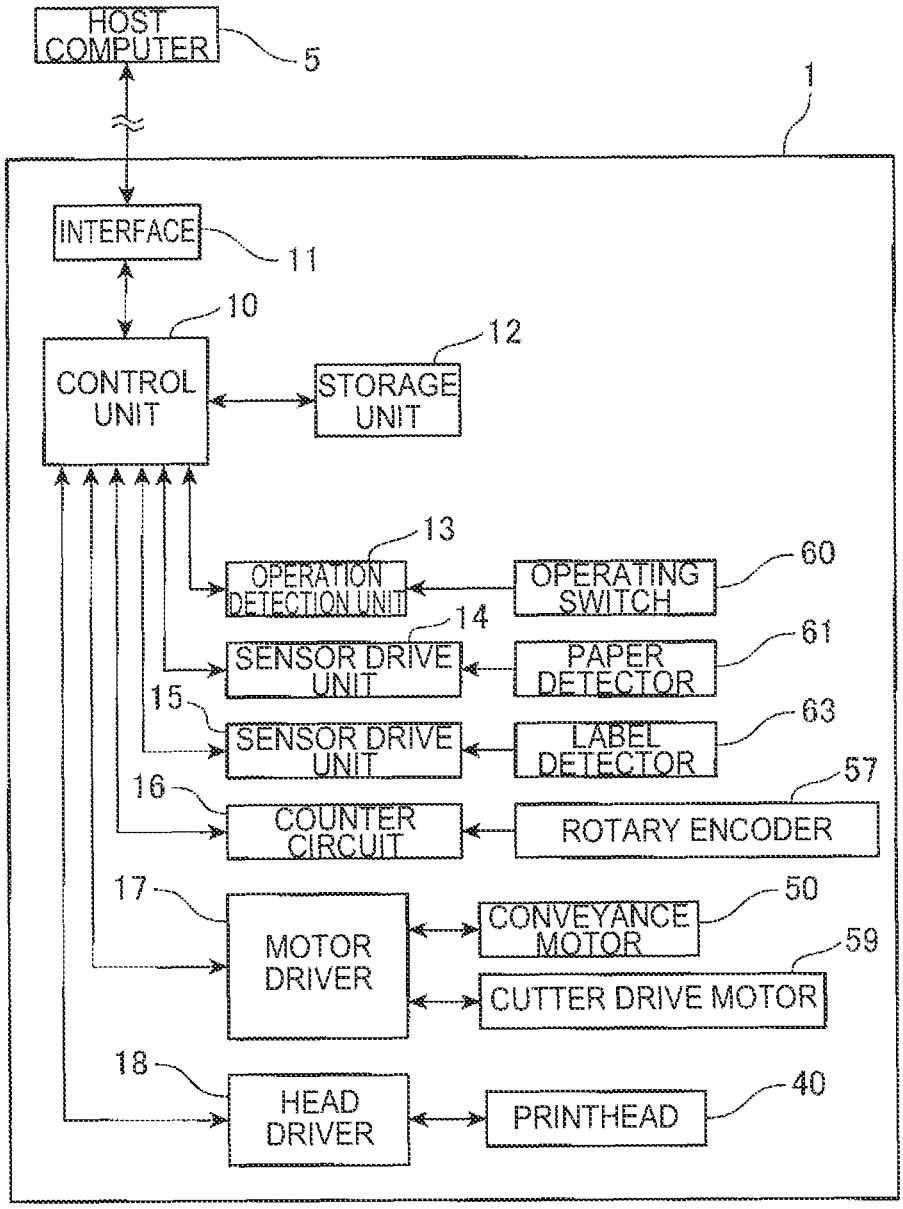
FIG. 1 is a function block diagram of a printer according to some embodiments.
Figure 2:
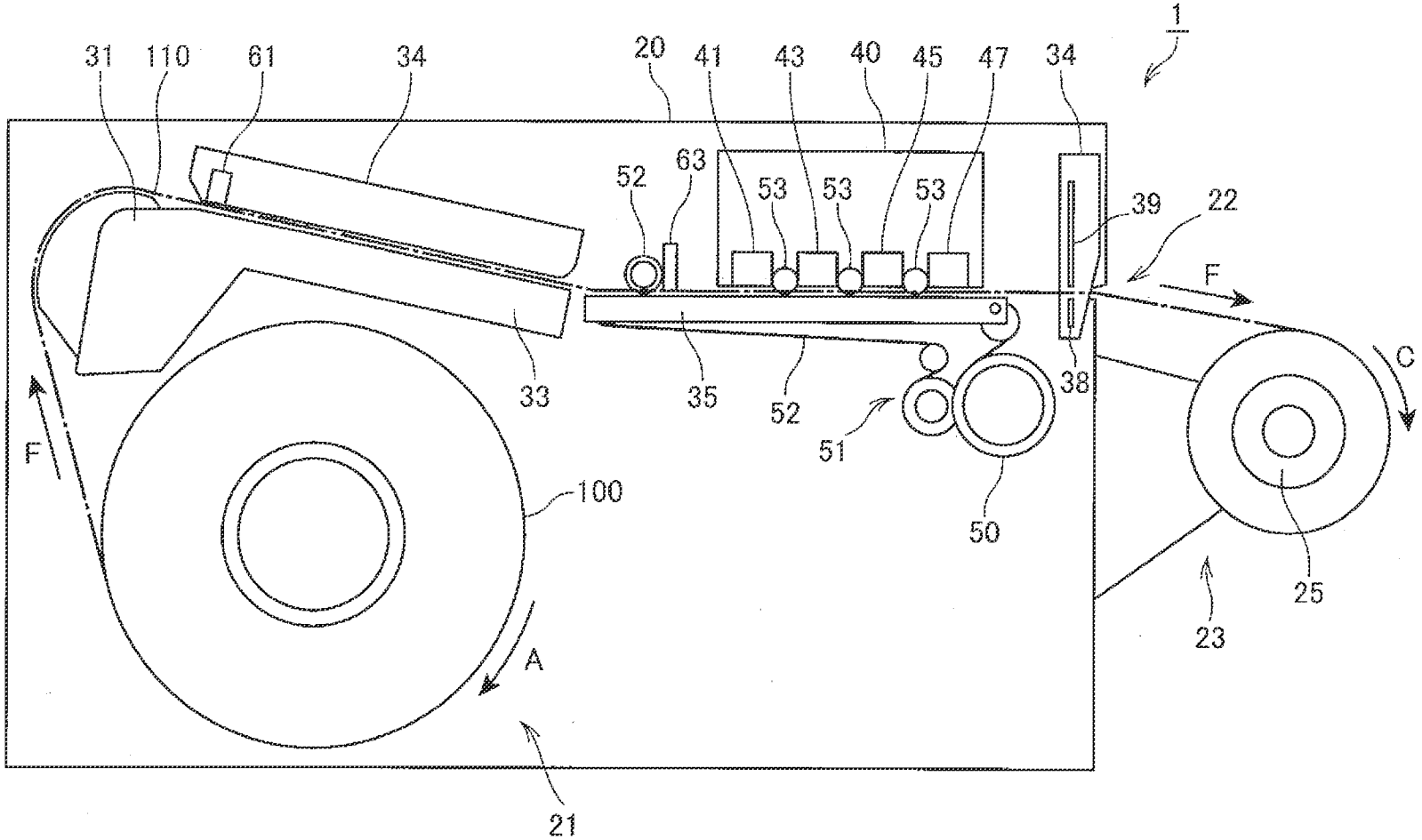
FIG. 2 is a side view schematically illustrating the configuration of the media conveyance path in the printer.

FIG. 1 is a function block diagram of a printer 1 (printing device) according to some embodiments of the invention. FIG. 2 is a side view schematically illustrating the configuration of the media conveyance path in the printer.

The printer 1 connects to an external host computer 5, receives commands and data sent by the host computer 5, and prints text and images on a print medium according to the received commands and data.

The print medium used for printing in the printer 1 may be cut-sheet media that is cut to a specific size or a continuous sheet medium, and the sheet media may be paper or plastic. The sheets may also be fine paper with a surface coating that is suitable for inkjet printing and improves ink absorbency and fixability.

Continuous sheet media include paper rolls that are stored in the printer 1 with the media wound into a roll, and fanfold paper that is stored in a stack outside the printer 1 and supplied therefrom to the printer 1. The roll paper may be plain paper or fine paper that is wound into a roll, or label paper having labels of a constant size with an adhesive coating on the back affixed to a continuous liner (backer) and wound into a roll.

In some embodiments of the invention, label paper 100 having labels 103 (FIG. 3, FIG. 7) of a constant size with an adhesive coating on the back affixed to a continuous peelable liner 101 (backer) (FIG. 3, FIG. 7) that can be released from the adhesive and is wound into a roll is used as the print medium. The label paper 100 has multiple labels 103 affixed at a regular interval along the length of the liner 101. The printer 1 conveys the label paper 100 and prints text or images on the printing surface of the labels 103 on the label paper 100. In this embodiment the label paper 100 is also referred to as the print medium, and the labels 103 are the print target.

As shown in FIG. 2, the label paper 100 is stored in a roll in the print media storage compartment 21 disposed inside the printer 1 housing, and the label paper 100 is pulled in the direction indicated by arrow F in the figure and conveyed inside the printer 1. The right side as seen in FIG. 2 is the front of the printer 1, and a paper exit 22 is formed in the front of the printer 1.

In FIG. 2, the conveyance path through which the label paper 100 is conveyed to the paper exit 22 is indicated by an imaginary line 110. A tension lever 31 that applies tension to the label paper 100 and prevents slack, and paper guides 33, 34 that guide the label paper 100, are disposed to the conveyance path 110. The one paper guide 33 is a platform that supports the label paper 100 from below, and the other paper guide 34 is located above the label paper 100 opposite the bottom paper guide 33 and prevents the label paper 100 from rising.

A print unit that prints on the label paper 100 is located downstream from (in front of) the paper guides 33, 34. The print unit includes a platen 35 and a printhead 40.

The printhead 40 in this embodiment ejects four colors of ink, cyan (C), magenta (M), yellow (Y), and black (K), to form dots on the printing surface of a label 103. The printhead 40 has a nozzle unit 41 that ejects black (K) ink, a nozzle unit 43 that ejects cyan (C) ink, a nozzle unit 45 that ejects magenta (M) ink, and a nozzle unit 47 that ejects yellow (Y) ink. The plural nozzles that eject the ink are disposed to the nozzle units 41 to 47 aligned in rows across the width of the label paper 100. The printhead 40 is thus an inkjet line head that can eject ink across the width of the label paper 100 without scanning. The nozzle rows of the nozzle units 41 to 47 are therefore at least as long as, or longer than, the width of the printable area 105 (FIG. 3) of the label paper 100. Some embodiments of the invention are described using an exemplary configuration in which the nozzle units 41, 43, 45, 47 are disposed in sequential order in the conveyance direction F of the label paper 100, but the nozzle units 41 to 47 can be arranged in any desirable order of colors in the conveyance direction F.

The platen 35 has a flat surface along the conveyance direction F. This flat surface is at the bottom of the conveyance path 110 opposite the printhead 40. The platen 35 is affixed to the frame of the printer 1 not shown, and supports the label paper 100 from below. The flat surface of the platen 35 is substantially horizontal when the printer 1 is installed and used.

A conveyance belt 52 is disposed along the top flat surface of the platen 35. The conveyance belt 52 is a wide endless belt that travels over the surface of the platen 35 and wraps around the bottom of the platen 35. The surface of the conveyance belt 52 is rough with a high coefficient of friction at least in the area that faces up when on the surface of the platen 35. The conveyance belt 52 is preferably made from an elastic material such as rubber or plastic.

A conveyance motor 50 and a drive mechanism 51 that moves the conveyance belt 52 using torque from the conveyance motor 50 are disposed below the platen 35. The conveyance motor 50 is a DC motor in this embodiment, and turns as controlled by the control unit 10 described below. The drive mechanism 51 includes a gear train that engages the output shaft of the conveyance motor 50 and rollers that move the conveyance belt 52, and the conveyance belt 52 moves and conveys the label paper 100 in the conveyance direction F when the conveyance motor 50 turns. The amount of rotation of the conveyance motor 50, or the distance the conveyance belt 52 moves in conjunction with rotation of the conveyance motor 50, is detected by a rotary encoder 57 (FIG. 1) described below.

A conveyance roller 55 is disposed opposite the conveyance roller 55 on the upstream side of the printhead 40. The conveyance roller 55 is a driven roller supported freely rotatably on the frame of the printer 1, and is urged toward the surface of the platen 35. The label paper 100 is held between the conveyance roller 55 and the conveyance belt 52 on the conveyance path 110, and is conveyed reliably in the conveyance direction F in conjunction with movement of the conveyance belt 52. A roller 53 that pushes against the label paper 100 so that the label paper 100 does not lift away from the conveyance belt 52 is disposed between the adjacent nozzle units 41, 43, 45, 47 of the printhead 40.

The conveyance motor 50, drive mechanism 51, conveyance belt 52, rollers 53, and conveyance roller 55 function as a conveyance unit that conveys the label paper 100. The conveyance mechanism is equivalent to all or part of this conveyance unit.

A cutter unit 37 is disposed on the downstream side of, that is, in front of, the printhead 40. The cutter unit 37 has a fixed knife 38 and a movable knife 39 disposed with the conveyance path 110 therebetween, and the movable knife 39 is linked to a cutter drive motor 59 (FIG. 1) through a gear train, for example. When the cutter drive motor 59 is driven, the movable knife 39 moves to the fixed knife 38 side, and cuts the label paper 100. The cutter unit 37 may make a partial cut leaving an uncut portion widthwise to the label paper 100, or it may completely cut the label paper 100. The printer 1 cuts the label paper 100 printed by the printhead 40 with the cutter unit 37, and discharges the cut portion from the paper exit 22.

A take-up unit 23 (recovery device) can be removably installed to the front of the printer 1 below the paper exit 22. The take-up unit 23 includes a winding drum 25 that takes up the label paper 100 discharged from the paper exit 22, and a drive unit not shown that turns the winding drum 25. The winding drum 25 is driven by a motor in the take-up unit 23, or is driven by torque transferred through a gear train not shown from the conveyance motor 50 of the printer 1. The winding drum 25 turns in the direction of arrow C in the figure, and takes up the label paper 100. When the take-up unit 23 is used, the printer 1 does not cut the label paper 100 with the cutter unit 37, and discharges the label paper 100 in a continuous stream from the paper exit 22. An entire roll of label paper 100 stored in the print media storage compartment 21 can therefore be printed and then rewound onto the winding drum 25 in a single operation of the printer 1, for example.

The printer 1 also has two detectors for detecting the label paper 100 on the conveyance path 110. More specifically, paper detector 61 (first detection unit, detector) is disposed to the upstream part of the paper guide 34, and a label detector 63 (second detection unit, detector) is disposed to the platen 35 on the upstream side of the printhead 40. The paper detector 61 and label detector 63 are, for example, optical sensors with an emitter part and a photodetection part.

The paper detector 61, for example, is a transmissive sensor having an emitter part on the paper guide 34 side, and a photodetection part on the paper guide 33 side. Because the output value (detection voltage) indicating the amount of light detected by the paper detector 61 differs according to whether or not label paper 100 is at the detection position of the paper detector 61, the leading end and the trailing end of the label paper 100 can be detected using the paper detector 61.

The label detector 63, for example, is a reflective sensor having the emitter part and the photodetection part above the platen 35. The output value (detection voltage) indicating the amount of light detected by the label detector 63 is different when the label paper 100 is not directly below the label detector 63, when only the liner 101 is present, and when a label 103 is present. More specifically, the amount of light is different in the reflection from the conveyance belt 52, the reflection from the liner 101, and the reflection from the label 103. As a result, the leading end and trailing end of the label paper 100, and the leading end and trailing end of a label 103, can be detected using the label detector 63.

The paper detector 61 and the control unit 10 work together to function as a first detection unit, and the label detector 63 and the control unit 10 likewise work together to function as a second detection unit. The paper detector 61, label detector label detector 63, and control unit 10 together render a detection means (detection unit).

As shown in FIG. 1, the printer 1 has a control unit 10 that controls parts of the printer 1. An interface 11 that connects to the host computer 5, and a storage unit 12 are connected to the control unit 10. The interface 11 connects by wire or wirelessly to the host computer 5.

The control unit 10 has a CPU as the operating unit, ROM, and RAM, all not shown. Firmware that can be executed by the CPU, and data related to the firmware, are nonvolatilely stored in the ROM of the control unit 10. Data related to the firmware run by the CPU is also temporarily stored in RAM. The control unit 10 may also have other peripheral circuits. The storage unit 12 nonvolatilely stores other programs and data. Control programs executed by the control unit 10, data related to these control programs, and commands and data the printer 1 receives from the host computer 5 are also stored in the storage unit 12.

An operation detection unit 13 that detects operation of operating switches 60 disposed to a switch panel (not shown in the figure) is connected to the control unit 10. The operating switches 60 include a paper feed switch that commands the conveyance operation of the printer 1, a cutter switch that instructs operating the cutter unit 37, and configuration switches for making various settings.

Sensor drive units 14, 15 that get the output values of the paper detector 61 and label detector 63 are also connected to the control unit 10. The sensor drive unit 14 supplies drive power to the paper detector 61 to emit, acquires the detection voltage output by the paper detector 61 according to the amount of light sensed, and outputs a detection value denoting the detected voltage to the control unit 10. The sensor drive unit 15 supplies drive power to the label detector 63 to emit, acquires the detection voltage output by the label detector 63 according to the amount of light sensed, and outputs a detection value denoting the detected voltage to the control unit 10.

A counter circuit 16 that counts the conveyance distance of the label paper 100 is also connected to the control unit 10. The counter circuit 16 is connected to a rotary encoder 57 that detects the amount the conveyance unit operates, that is, how far the conveyance belt 52 moves, the amount of rotation of the conveyance motor 50, and the amount of rotation of the conveyance roller 55. The counter circuit 16 counts the pulses output by the rotary encoder 57 as controlled by the control unit 10, and outputs the count to the control unit 10.

A motor driver 17 that drives the conveyance motor 50 and cutter drive motor 59, and a head driver 18 that drives the printhead 40, are connected to the control unit 10. The motor driver 17 supplies drive current to the conveyance motor 50 and to the cutter drive motor 59 as controlled by the control unit 10. If the cutter drive motor 59 is a stepper motor, for example, the motor driver 17 also outputs drive pulses to the cutter drive motor 59 to control how much the cutter drive motor 59 turns.

The head driver 18 supplies voltage to and operates a pump (not shown in the figure) that supplies ink from an ink tank (not shown in the figure) to the printhead 40, and the piezo devices (not shown in the figure) disposed to the nozzle units 41 to 47 of the printhead 40. As a result, ink droplets are discharged from the nozzles of the nozzle units 41 to 47 and dots are formed.

Embodiment 1

A first embodiment of the invention is described in detail below with reference to FIG. 3 to FIG. 6.

Figures 3A, 3B:
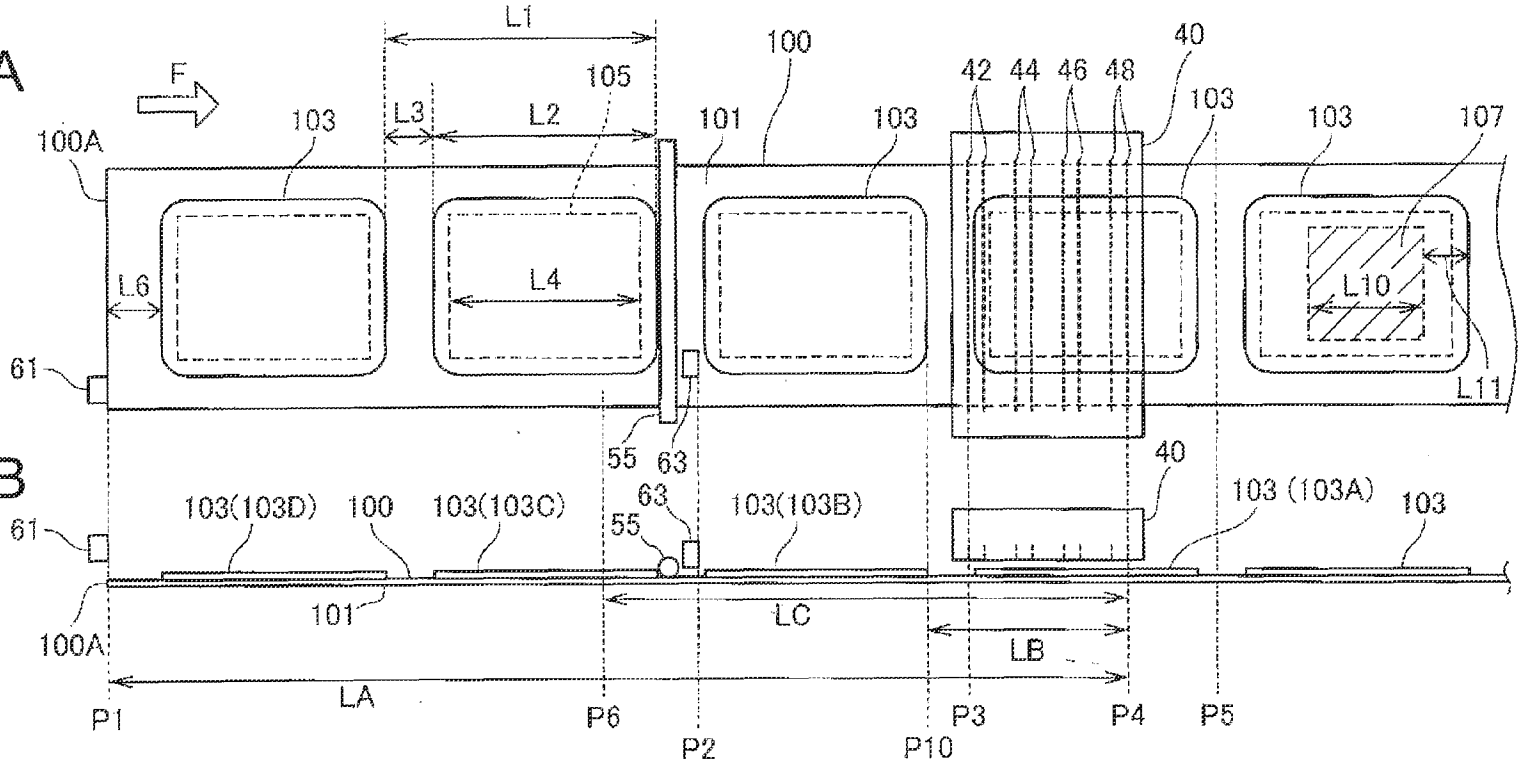
FIGS. 3A and 3B illustrate the relative positions of parts along the conveyance path.

FIG. 3 illustrates the relative positions of parts along the conveyance path 110 of the label paper 100. FIG. 3 (A) is a plan view, and FIG. 3 (B) is a side view, and the same positions in the conveyance direction F are shown aligned in (A) and (B). FIG. 3 shows the state when the trailing end 100A of the label paper 100 has been detected by the paper detector 61 as described below.

The nozzle rows 42, 44, 46, 48 of the nozzle units 41, 43, 45, 47 (FIG. 1) of the printhead 40 are shown in FIGS. 3 (A) and (B). The nozzles of the nozzle unit 41 in nozzle rows 42 are arrayed across the width of the label paper 100. In some embodiments of the invention, the nozzle units 41, 43, 45, 47 each have two rows of nozzles. More specifically, in order from the upstream side in the conveyance direction F, the printhead 40 has two nozzle rows 42 that eject K ink, two nozzle rows 44 that eject C ink, two nozzle rows 46 that eject M ink, and two nozzle rows 49 that eject Y ink.

As described above, the label paper 100 has labels 103 disposed with a constant gap therebetween on the liner 101. The printer 1 stores a logical label length L1 as an index to the length of each label 103. The logical label length L1 is sent by operating a specific operating switch 60 or sending a command from the host computer 5 to the printer 1, and is stored in the storage unit 12 or the ROM of the control unit 10 in a data type that can be read by the control unit 10. The logical label length L1 is the length in the conveyance direction F, and includes label length L2, which is the actual length of the label 103, and gap length L3, which the length of the gap between one label 103 and the next label 103. The logical label length L1 is thus the length from the leading end of one label 103 to the leading end of the next label 103.

The area where text or images can be printed on a label 103 is the printable area 105 denoted by the dotted line in each label 103. The printable area 105 is determined based on the size of the label 103 and the printer 1 specifications including the length of the nozzle rows 42 to 48 in the transverse direction. The length of the printable area 105 is printable length L4. The length used as the printable length L4 is set and stored in the printer 1 in the same way as the logical label length L1. The width of the label paper 100, the width of a label 103, and the width of the printable area 105 may also be preset and stored in the printer 1 with the printable length L4.

The text or image printed on the label 103 by the printhead 40 is shown as print image 107 in FIG. 3 (A), and the length of the print image 107 is print length L10. The control unit 10 can determine the print length L10 based on the print data received from the host computer 5. The length of the white space from the leading end of the label 103 to the leading end of the print image 107 is print data offset L11.

The labels 103 are affixed to the label paper 100 to near the trailing end 100A, and a margin of length L6 (margin length) is between the end of the last label 103 and the trailing end 100A of the label paper 100. The margin length L6 is shorter than the logical label length L1 and label length L2, and in this embodiment gap length L3 is equal to the margin length L6. In addition, there may not be a margin if the label paper 100 is cut shorter than the normal length.

<<Embodiment 2 Differs from Here>>

FIGS. 3 (A) and (B) illustrate plural positions P1 to P6 and P10 in the conveyance direction F of the printer 1. These positions P1 to P6 and P10 are reference positions for the control unit 10 to control conveying and printing on the label paper 100.

Position P1 is the detection position of the paper detector 61. As shown in FIG. 3, when the trailing end 100A of the label paper 100 (the end of the roll) passes detection position P1, the detection value of the paper detector 61 changes. Based on change in the detection value output from the paper detector 61, the control unit 10 detects that the trailing end 100A has reached the detection position P1. After detecting the trailing end 100A by means of the paper detector 61, the control unit 10 can continuously know the position of the trailing end 100A by calculating the conveyance distance of the recording medium based on the increase in the count kept by the counter circuit 16.

Detection position P2 is the detection position of the label detector 63. When the leading end or the trailing end of a label 103 passes this detection position P2, the detection value output from the label detector 63 changes. Based on change in the detection value output from the label detector 63, the control unit 10 detects that the leading end or the trailing end of a label 103 reached the detection position P2. In this embodiment, the printer 1 detects the leading end of the label 103 by means of the label detector 63. The trailing end of the label 103 can be obtained by adding logical label length L1 to the leading end of the label 103, for example.

Position P3 is the position of the nozzle row 42 that is located at the farthest upstream end of the printhead 40.

Position P4 is the position of the nozzle row 48 that is located at the farthest downstream end of the printhead 40. Because printing on the label 103 finishes when the trailing end of the label 103 reaches position P4, position P4 is referred to below as the final printing position P4. By comparing the length from this final printing position P4, the control unit 10 can determine whether or not printing can be completed to the end of the label 103. More specifically, the final printing position P4 is used as the reference position for deciding if printing can be completed.

Position P5 is the cutting position where the cutter unit 37 cuts the label paper 100. An operation that passes the label paper 100 through the cutting position P5 without cutting the label paper 100 with the cutter unit 37 is also obviously possible.

Position P6 is the position corresponding to the shortest length of label paper 100 required to complete printing with the printhead 40 when using the take-up unit 23. This is called the nipping limit position P6 below. Because the force of winding the label paper 100 onto the winding drum 25 is applied to the label paper 100 when using the take-up unit 23, the label paper 100 must be nipped (held) with sufficient resistance to this pulling force. The printer 1 holds the label paper 100 with the conveyance roller 55 and the conveyance belt 52, and resists the pulling force of the take-up unit 23. The nipping limit position P6 is an index for determining if the conveyance roller 55 can hold the label paper 100 until printing on a label 103 ends. If the trailing end 100A is at the nipping limit position P6 or on the upstream side of position P6, the label paper 100 can be conveyed normally in resistance to the pulling force of the take-up unit 23. If the label paper 100 is downstream from the nipping limit position P6, the label paper 100 will be pulled out by the pulling force of the take-up unit 23, and cannot be printed normally.

The length of the label paper 100 and other parameters required to convey a label 103 at a set speed are determined by the mechanical constructions disposed to the conveyance path 110 of the printer 1. If the remaining length of label paper 100 is short, finishing printing on labels 103 near the trailing end 100A may not be possible. Because labels 103 that cannot be completely printed are not used and discarded, labels 103 that cannot be completely printed are preferably discharged without printing and the roll is replaced in order to suppress wasting time, ink, and other consumables.

When the trailing end 100A is detected by the paper detector 61 located at the farthest upstream end, the control unit 10 of the printer 1 in some embodiments of the invention determines if the label 103 detected by the label detector 63 can be printed. The control unit 10 then exercises control to not print unnecessarily on labels 103 that cannot be printed completely.

Being unable to print a label 103 occurs when the label 103 cannot be conveyed at the set specific conveyance speed until printing the label 103 is completed, and when the trailing end of the label 103 is cut off, for example.

To print normally to the end of the label 103 when using the take-up unit 23, the trailing end 100A must remain at or on the upstream side of the nipping limit position P6 until printing is completed as described above. When not using the take-up unit 23, the label paper 100 must only be held between a roller 53 and the conveyance belt 52 until printing ends, and the trailing end 100A only needs to be upstream from the final printing position P4 until printing ends.

To determine whether or not printing can be completed, the control unit 10 uses the length LA from the final printing position P4 to the trailing end 100A. When the trailing end 100A is detected by the paper detector 61, the control unit 10 sets length LA to the distance from the final printing position P4 to the detection position P1. The control unit 10 then gradually decreases length LA in conjunction with conveyance of the label paper 100.

To determine if printing can be completed on each label 103, the control unit 10 uses length LB from the trailing end of a particular label 103 to the final printing position P4. In the example shown in FIG. 3, the distance from the final printing position P4 to position P10 of label 103B is length LB, for example. When the trailing end of label 103B, for example, is detected by the label detector 63, the control unit 10 sets length LB for the detected label 103B to the distance from the final printing position P4 to the detection position P2. The control unit 10 then gradually decreases length LB in conjunction with conveyance of the label paper 100.

When using the take-up unit 23, the distance LC from the final printing position P4 to the nipping limit position P6 is used as a decision criteria.

The locations of the detection positions P1, P2, the final printing position P4, and the nipping limit position P6, and the distances between these positions (such as distance LC) are determined by the mechanical configuration of the printer 1, are previously set in the printer 1, and are stored as data that the control unit 10 can reference.

A process whereby the control unit 10 determines whether or not a label 103 can be printed is described next.

When the label detector 63 detects the leading end of a label 103, the control unit 10 sets the length LB from the leading end of the label 103 to the final printing position P4. This length LB is set for each individual label 103 detected by the label detector 63, and is decreased in conjunction with conveyance of the label paper 100.

When the paper detector 61 detects the trailing end 100A of the label paper 100, the control unit 10 sets length LA, and based on this length LA and the length LB of each label 103 that is detected, determines for the detected label 103 whether or not printing can be completed.

The reference for this decision differs according to whether or not the take-up unit 23 is used.

As described above, when the take-up unit 23 is not used, the trailing end 100A must be upstream of the final printing position P4 when the trailing end of the label 103 reaches the final printing position P4. More precisely, the trailing end 100A may be at the final printing position P4.

The conveyance distance until the trailing end of a label 103 reaches the final printing position P4 is obtained from equation (1).

$$\text{conveyance distance} = \text{length } LB + \text{logical label length } L1 \quad (1)$$

In order to complete printing, the remaining length LA of the label paper 100 must be greater than or equal to the conveyance distance obtained from equation (1). More specifically, the relationship in equation (2) below must be true.

$$\text{length } LA >= \text{length } LB + \text{logical label length } L1 \quad (2)$$

The control unit 10 can determine whether or not printing on a label 103 can be completed by determining if the relationship in equation (2) is true.

However, when using the take-up unit 23, the trailing end 100A must be at or upstream of the nipping limit position PG when the trailing end of the label 103 reaches the final printing position P4.

The conveyance distance until the trailing end of the label 103 reaches the final printing position P4 can be obtained from equation (1) above.

To complete printing, the remaining length LA of the label paper 100 must be at least equal to the length of the conveyance distance obtained from equation (1) plus the distance LC from the final printing position P4 to the nipping limit position P6. More specifically, the relationship defined in equation (3) must be true.

$$\text{length } LA >= \text{length } LB + \text{logical label length } L1 + \text{distance } LC \quad (3)$$

The control unit 10 determines whether or not printing the label 103 can be completed based on whether or not equation (3) is true.

If distance LC is 0, then equation (3) is reduced to equation (2). More specifically, when the take-up unit 23 is not used, the required length from the end of the label 103 to the final printing position P4 is 0, resulting in equation (2). Therefore, equations (2) and (3) can be replaced by equation (4) below.

$$\text{length } LA >= \text{length } LB + \text{logical label length } L1 + \text{required remaining length} \quad (4)$$

The required remaining length in the above equation indicates the length required from the end of the label 103 to the final printing position P4, and is 0 in equation (2) and distance LC in equation (3).

Note that length LA and length LB decrease in the same way with conveyance of the label paper 100, but the required remaining length is a fixed value. Therefore, the timing for the decision based on equation (4) is not limited. The control unit 10 can make this decision any time after the leading end of the target label 103 has been detected by the label detector 63, and the trailing end 100A of the label paper 100 is detected by the paper detector 61.

Figure 4:
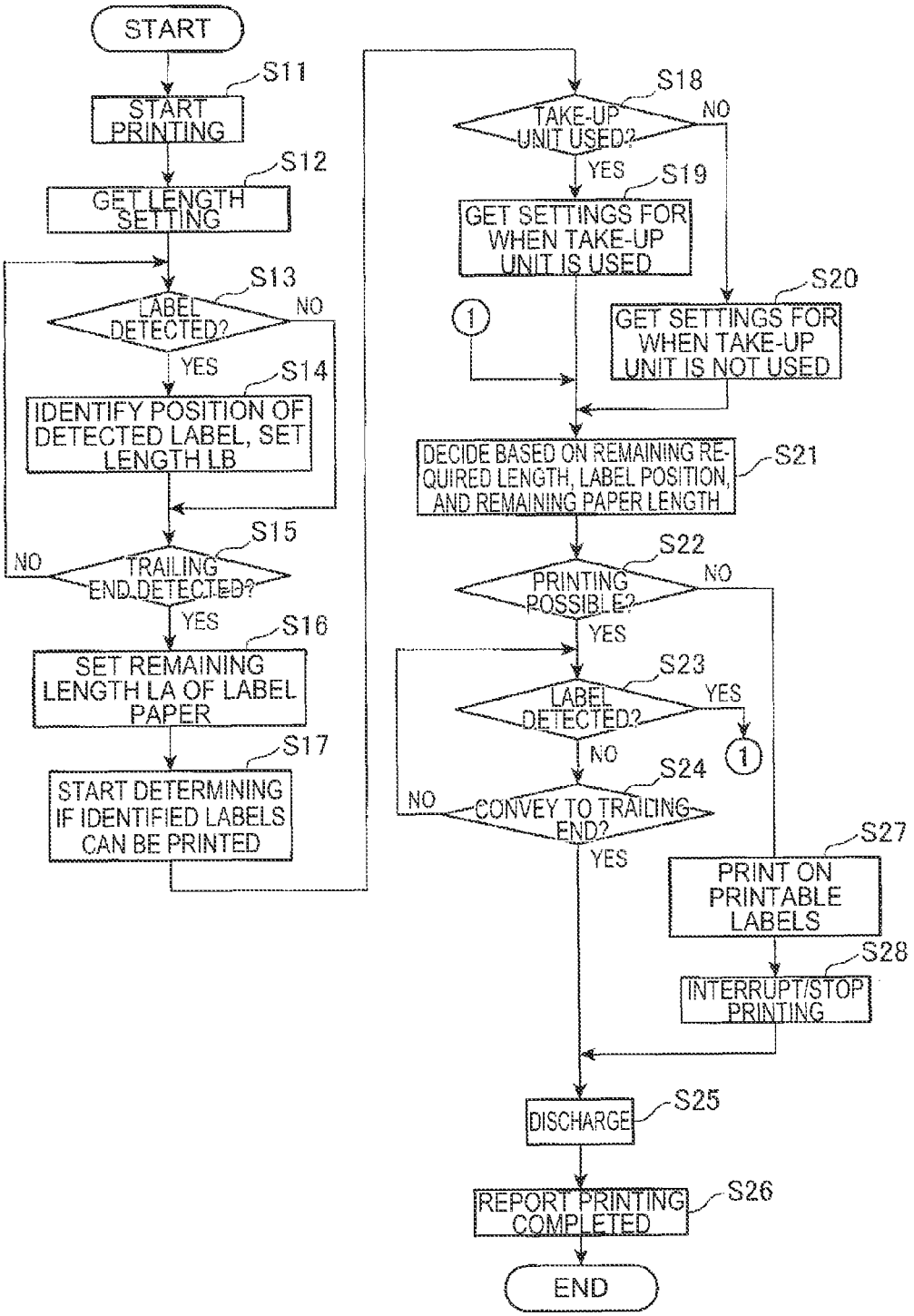
FIG. 4 is a flow chart illustrating the operation of the printer.

FIG. 4 is a flow chart illustrating the operation of the printer 1.

The control unit 10 receives print commands and print data from the host computer 5 and starts the printing operation (step S11), and then acquires the logical label length L1 of the label paper 100 in the print media storage compartment 21 from the storage unit 12 or ROM before starting to print (step S12).

The control unit 10 then monitors if the label detector 63 detects the leading end of a label 103 (step S13). If a label 103 is detected (step S13 returns YES), the control unit 10 sets length LB using the detection position P2 as the position of the leading end of the label 103, and then starts decreasing length LB (step S14).

Note that the control unit 10 decreases length LB while conveying the label paper 100, and when length LB goes to 0, clears length LB for that label 103.

Next, the control unit 10 monitors detection of the trailing end 100A by the paper detector 61 (step S15). If the trailing end 100A is not detected (step S13 returns NO), the control unit 10 returns to step S13 and continues monitoring detection of a label 103. The control unit 10 continues printing during this time. If a label 103 is not detected by the label detector 63 (step S13 returns NO), step S14 is skipped and control goes to step S15.

When the paper detector 61 detects the trailing end 100A (step S15 returns YES), the control unit 10 sets the remaining length LA of the label paper 100 (step S16). The length LA that is set in this step is decreased as described above. The control unit 10 then starts determining if printing to the end of the printable area 105 is possible for the label 103 that was already detected by the label detector 63 and the length LB was set (step S17). For convenience of description, some embodiments of the invention determine whether or not printing is possible to the end of the label 103. The following process also does not make this decision for any label 103 that has finished printing, that is, for any label 103 for which the length LB has been cleared.

The control unit 10 determines if the take-up unit 23 is being used (step S18). The printer 1 is configured so that the control unit 10 can determine if the take-up unit 23 is used. For example, using the take-up unit 23 can be turned on/off by sending a command from the host computer 5 to the printer 1. A sensor that operates mechanically when the take-up unit 23 is installed could also be disposed to a position at the front of the printer 1 where the take-up unit 23 is installed, and the presence of the take-up unit 23 may be detected based on the output of this sensor.

When the take-up unit 23 is used (step S18 returns YES), the control unit 10 retrieves the setting of the length required when the take-up unit 23 is used (step S19). More specifically, the control unit 10 gets the value of distance LC from the storage unit 12. When the take-up unit 23 is not used (step S18 returns NO), the control unit 10 retrieves the setting of the length required when the take-up unit 23 is not used (step S20). The setting of the length required when the take-up unit 23 is not used is 0 in this embodiment.

After steps S19 and S20, the control unit 10 computes equation (4) above based on the acquired setting of the required length, the length LB set in step S14, and the remaining length LA of the label paper 100 set in step S16 (step S21).

The control unit 10 then determines if the label 103 can be printed based on the result of calculating equation (4) (step S22). If there are plural labels 103 to be evaluated in steps S21 and S22, the control unit 10 proceeds sequentially from the label 103 at the downstream end of the plural labels 103.

If printing all labels 103 already detected by the label detector 63 is possible (step S22 returns YES), the control unit 10 monitors the output of the label detector 63 until the next label 103 is detected by the label detector 63 (step S23). While a label 103 is not detected (step S23 returns NO), the control unit 10 checks if the trailing end 100A was conveyed to the final printing position P4 (step S24). More specifically, the control unit 10 determines if the remaining length LA to the trailing end 100A went to 0, and if length LA is not 0 (step S24 returns NO), control goes to step S23. If length LA goes to 0 (step S24 returns YES), the control unit 10 discharges the label paper 100 from the paper exit 22 (step S25), reports the end of printing to the host computer 5 (step S26), and ends this process.

If a label 103 is detected by the label detector 63 (step S23 returns YES), the control unit 10 sets the length LB for that label 103 and returns to step S21.

However, if the control unit 10 determines that no label 103 detected by the label detector 63 can be printed (step S22 returns NO), the control unit 10 continues printing until printing the label 103 determined to be printable is completed (step S27). Next, the printing is stopped before starting to print a label 103 determined to be unprintable (step S28), control goes to step S25, and the label paper 100 is discharged. If printing on a label 103 determined in step S22 to be unprintable to the end has already started, the control unit 10 immediately aborts printing in step S28 and then goes to step S25.

Figures 5A, 5B, 5C:
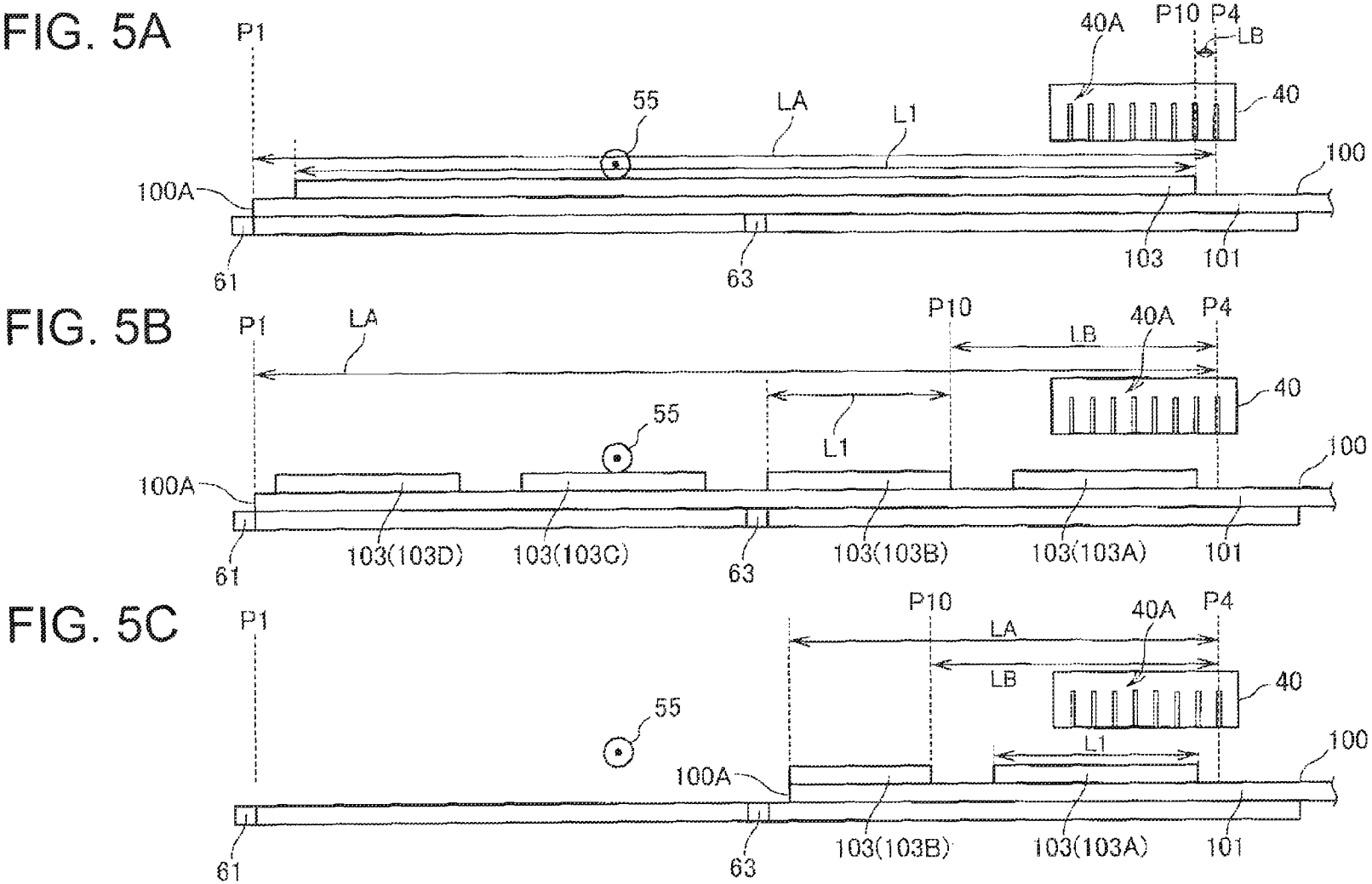
FIGS. 5A, 5B and 5C illustrate a specific example of the operation of the printer.
Figure 6:
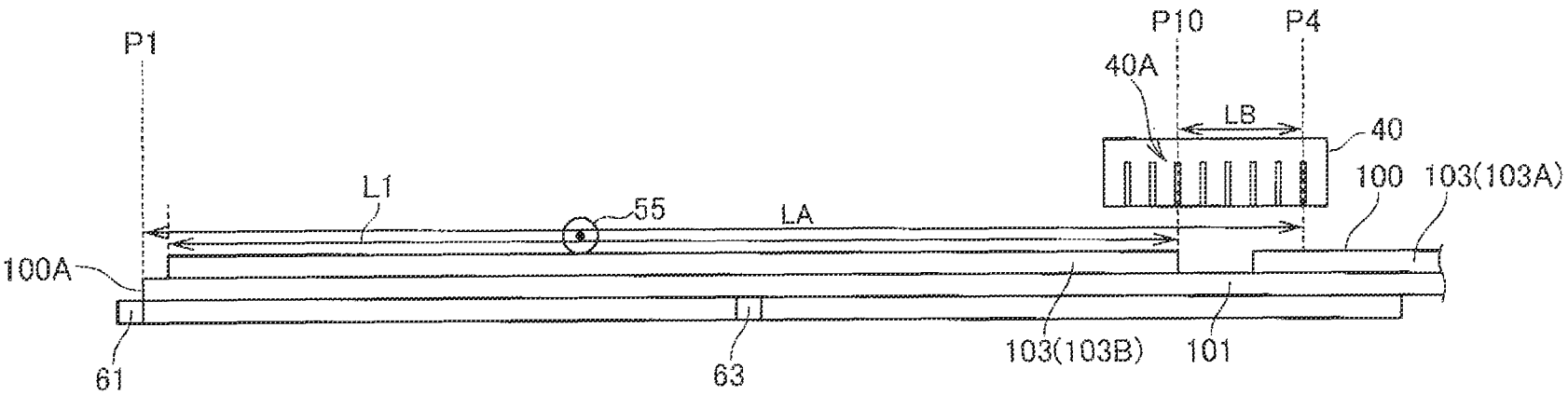
FIG. 6 illustrates a specific example of the operation of the printer.

FIG. 5 and FIG. 6 illustrate a specific example of printer 1 operation.

FIG. 5 (A), FIG. 5 (B), and FIG. 5 (C), and FIG. 6 show various examples that differ, for example, in the length of the labels 103.

FIG. 5 (A) shows an example of printing to a label 103 with a long logical label length L1. In the example in FIG. 5 (A), the leading end of the label 103 is near the final printing position P4 when the paper detector 61 detects the trailing end 100A after the label detector 63 has detected the leading end of the label 103. In this event, the control unit 10 determines if printing is possible in steps S21 and S22 in FIG. 4 after the trailing end 100A is detected. In the example shown in FIG. 5 (A), printing can be completed when the take-up unit 23 is not used, and printing cannot be completed when the take-up unit 23 is used, as described with reference to equation (4) above. When printing cannot be completed, the control unit 10 discharges the label paper 100 without printing the label 103, and can therefore prevent wasting ink.

In the example shown in FIG. 5 (B), the label paper 100 carries multiple labels 103 that are each shorter than length LA. As shown in FIG. 5 (B), when the trailing end 100A is detected by the paper detector 61, the control unit 10 determines whether or not the labels 103 already detected by the label detector 63 (labels 103A, 103B) can be printed. For example, if the control unit 10 determines label 103B cannot be printed, it discharges the label paper 100 after finishing printing label 103A. Because the label 103B that cannot be printed is not printed in this event, ink waste can be prevented. Processing is also efficient because whether or not printing is possible is not determined for labels 103C, 103D located after (upstream of) label 103B.

In the example illustrated in FIG. 5 (C), the label 103B near the trailing end 100A is cut short. Whether or not printing is possible can also be determined in this event by comparing the remaining length LA of the label paper 100 with the length LB set for the labels 103 based on equation (4) above. In the example in FIG. 5 (C), the remaining length LA of the label paper 100 is short as a result of the end being cut off. However, length LB of label 103B does not change even if the trailing end of label 103B is cut off. It is therefore determined that label 103B cannot be printed. Note that the control unit 10 can determine if a label 103 has been cut by comparing the remaining length LA of the label paper 100 with the logical label length L1. If the label 103 is determined to have been cut, the control unit 10 determines that label 103 cannot be printed even without processing equation (4).

FIG. 6 illustrates an example in which a first label 103A is being printed when it is determined that a following label 103 near the end of the label paper 100 cannot be printed. In this event, the control unit 10 stops printing and discharges the label paper 100 after printing label 103A is completed as described in step S27 in FIG. 4.

As described above, the printer 1 according to some embodiments of the invention has a conveyance mechanism that conveys label paper 100 having labels 103 that are the printing media, and a printhead that prints on the labels 103. The printer 1 also has a paper detector 61 that detects the trailing end 100A of the label paper 100 on the conveyance path, and a label detector 63 that detects the labels 103. A control unit 10 determines based on the position of the trailing end 100A detected by the paper detector 61 whether or not printing on a label 103 detected by the label detector 63 can be completed. If the control unit 10 determines that printing cannot be completed, it interrupts or avoids printing on that label 103. For example, if it is determined that printing on a label 103 cannot be completed, the control unit 10 stops printing if printing that label 103 has already started, and discharges the paper without printing if printing has not already started. Because printing is thus stopped or avoided if printing on a label 103 cannot be completed, unnecessary printing operations can be suppressed, and wasting the consumables and time required for printing can be omitted.

For labels 103 detected by the label detector 63 before the trailing end 100A is detected by the paper detector 61, the control unit 10 determines if printing is possible after the paper detector 61 detects the trailing end 100A. As a result, whether or not printing is possible can also be determined for labels 103 that had already passed the detection position of the label detector 63 when the paper detector 61 detected the trailing end 100A.

Multiple labels 103 of a specific length are affixed to the label paper 100 along the conveyance direction, and the control unit 10 does not determine if printing is possible on any of the labels 103 that are located upstream from the label 103 that is determined to be unprintable. As a result, when there is a label 103 that cannot be completely printed, the labels 103 scheduled to be printed thereafter are not evaluated, and an operation other than printing can be executed quickly. For example, if there is a label 103 that cannot be completely printed because the remaining length of label paper 100 is insufficient, a label 103 to be printed after that label 103 can clearly not be printed. The process can be made more efficient in this event by skipping the evaluation step. The label paper 100 can also be efficiently processed, such as quickly discharging the paper when there is a label 103 that will not be printed normally.

In the process of determining if a label 103 can be printed, the control unit 10 determines if the label paper 100 can be conveyed until printing the label 103 is completed based on the position of the trailing end 100A of the label paper 100. As a result, if the remaining length of label paper 100 is insufficient, it can be quickly determined that printing cannot be completed, and whether or not the label 103 can be printed can be appropriately determined.

The control unit 10 makes this decision based on the setting of the remaining length of the label paper 100 required to convey the label paper 100 until printing on a label 103 is completed. The setting of the remaining length of the label paper 100 is, for example, the required remaining length described above. Based on the preset value stored in the storage unit 12, the control unit 10 can appropriately determine if printing on the label 103 is possible.

A take-up unit 23 that can recover the label paper 100 after printing can also be installed to the printer 1 on the downstream side of the printhead. In this embodiment, the take-up unit 23 can be attached at the paper exit 22. The control unit 10 determines the printability of a label in this configuration based on the setting of the required remaining length of label paper 100 corresponding to whether or not the take-up unit 23 is installed. Whether or not a label 103 can be printed can therefore be appropriately determined with consideration for whether or not the take-up unit 23 is used.

Embodiment 2

A second embodiment of the invention is described next with reference to FIG. 7 to FIG. 12.

Figures 7A, 7B:
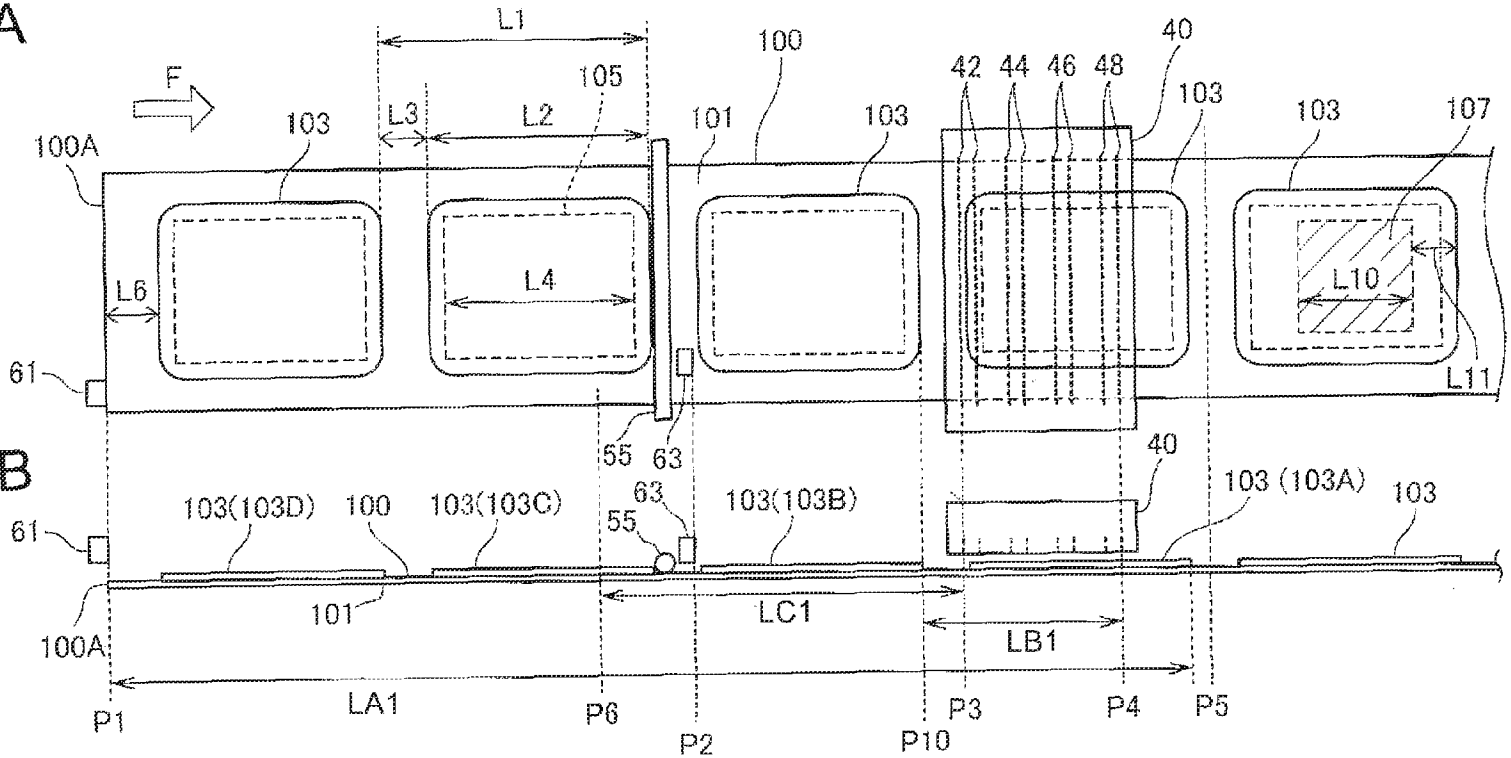
FIGS. 7A and 7B illustrate the relative positions of parts along the conveyance path.

FIG. 7 illustrates the relative positions of parts along the conveyance path 110 of the label paper 100. Note that parts that are the same in FIG. 7 and FIG. 3 of the first embodiment are identified by the same reference numerals, and further description thereof is omitted. FIG. 7 (A) is a plan view, and FIG. 7 (B) is a side view, and the same positions in the conveyance direction F are shown aligned in (A) and (B). FIG. 7 shows the state when the trailing end 100A of the label paper 100 has been detected by the paper detector 61 as described below.

FIGS. 7 (A) and (B) illustrate plural positions P1 to P6 and P10 in the conveyance direction F of the printer 1. These positions P1 to P6 and P10 are reference positions for the control unit 10 to control conveying and printing on the label paper 100.

Position P1 is the detection position of the paper detector 61. As shown in FIG. 7, when the trailing end 100A of the label paper 100 (the end of the roll) passes detection position P1, the detection value of the paper detector 61 changes. Based on change in the detection value output from the paper detector 61, the control unit 10 detects that the trailing end 100A has reached the detection position P1. After detecting the trailing end 100A by means of the paper detector 61, the control unit 10 can continuously know the position of the trailing end 100A by calculating the conveyance distance of the recording medium based on the increase in the count kept by the counter circuit 16.

Detection position P2 is the detection position of the label detector 63. When the leading end or the trailing end of a label 103 passes this detection position P2, the detection value output from the label detector 63 changes. Based on change in the detection value output from the label detector 63, the control unit 10 detects that the leading end or the trailing end of a label 103 reached the detection position P2.

Position P3 is the position of the nozzle row 42 that is located at the farthest upstream end of the printhead 40, and is referred to below as printing reference position P3.

Position P4 is the position of the nozzle row 48 that is located at the farthest downstream end of the printhead 40, and is referred to below as the final printing position P4.

Position P5 is the cutting position where the cutter unit 37 cuts the label paper 100. An operation that passes the label paper 100 through the cutting position P5 without cutting the label paper 100 with the cutter unit 37 is also obviously possible.

Position P6 is the position corresponding to the shortest length of label paper 100 required to complete printing with the printhead 40 when using the take-up unit 23, and is called the nipping limit position P6 below. Because the force of winding the label paper 100 onto the winding drum 25 is applied to the label paper 100 when using the take-up unit 23, the label paper 100 must be nipped (held) by the conveyance roller 55 and conveyance belt 52 with sufficient resistance to this pulling force. The nipping limit position P6 is an index for determining if the conveyance roller 55 can hold the label paper 100 until printing on a label 103 ends. The decision process based on this nipping limit position P6 is described below.

The length of the label paper 100 and other parameters required to print a label 103 are determined by the mechanical constructions disposed to the conveyance path 110 of the printer 1. As a result, if the remaining length of label paper 100 is short, finishing printing on labels 103 near the trailing end 100A may not be possible. Because a label 103 that cannot be completely printed is not used and discarded, if a print image 107 is printed on the label 103, the time, ink, and other consumables required for printing are wasted. In this event, labels 103 that cannot be completely printed are preferably discharged without printing and the roll of label paper 100 is replaced.

When the trailing end 100A is detected by the paper detector 61 located at the farthest upstream end, the control unit 10 of the printer 1 in some embodiments of the invention determines if the label 103 located between the detection position P1 of the paper detector 61 and the final printing position P4 can be printed. The control unit 10 then exercises control to not print unnecessarily on labels 103 that cannot be printed completely.

Being unable to print a label 103 occurs when the label 103 cannot be conveyed at the set specific conveyance speed until printing the label 103 is completed, and when the trailing end of the label 103 is cut off, for example.

In order for the printhead 40 to print a label 103 normally when not using the take-up unit 23 in some embodiments of the invention, the roller 53 and conveyance belt 52 must be able to hold and stably convey the label paper 100. More specifically, the label paper 100 must be held by at least the farthest downstream roller 53 until the nozzle row 48 at the farthest downstream end finishes printing the last part of the print image 107.

Because the force of winding the label paper 100 onto the winding drum 25 is applied to the label paper 100 when using the take-up unit 23 in this embodiment, the label paper 100 must be held by the conveyance roller 55 and conveyance belt 52 with sufficient resistance to this pulling force. Completion of printing in some embodiments of the invention means that printing ends normally while maintaining print quality, and is equivalent to being able to finish printing text or images to the target label 103 under the foregoing conditions.

When the paper detector 61 detects the trailing end 100A, the control unit 10 identifies all labels 103 between the detection position P1 and the final printing position P4. The labels 103 identified at this time include any label 103 straddling the final printing position P4. In the example in FIG. 7, the four labels 103 including the label 103A straddling the final printing position P4, and label 103B to label 103D, are identified.

The control unit 10 obtains length LA1 for each of the identified labels 103A to 103D. This length LA1 is the length from the leading end of the label to the trailing end 100A of the label paper 100.

The control unit 10 also obtains length LB1 for each of the identified labels 103A to 103D. This length LB1 is the length from the final printing position P4 to the trailing end of the label 103. Because the control unit 10 processes the trailing end of the label 103 as the trailing end based on logical label length L1, length LB1 of label 103A in FIG. 7, for example, is actually equal to the length from the final printing position P4 to the leading end of the next label 103B.

The control unit 10 also acquires the distance LC1 from the printing reference position P3 to the nipping limit position P6. Because the position of the nipping limit position PG and distance LC1 are determined by the mechanical configuration of the printer 1, these values are preset in the printer 1, and are stored as data that the control unit 10 can reference.

The control unit 10 calculates length LA1 and length LB1 for each of the identified labels 103A to 103D when the trailing end 100A is detected by the paper detector 61. The trailing end of the label 103 for calculating length LA1 and length LB1 is the position from the leading end of the label 103 plus the logical label length L1, and includes the gap length L3. For convenience, length LA1 and length LB1 calculated by the control unit 10 for label 103A are shown in FIG. 7.

The process whereby the control unit 10 determines if printing is possible is described next.

The control unit 10 compares length LA1 with the logical label length L1 for each label 103 (labels 103A to 103D) identified when the paper detector 61 detects the trailing end 100A. If length LA1 is shorter than logical label length L1, the end of the label 103 will be reached before printing ends. This can happen when, for example, the label paper 100 has been cut. The control unit 10 does not print to the label 103 if length LA1 is shorter than the logical label length L1. Note that length LA1<L1 when the label 103 is the label closest to the trailing end 100A (label 103D in the example in FIG. 7). To improve process efficiency, the control unit 10 may compare length LA1 with logical label length L1 only if the identified label 103 is the label 103 closest to the trailing end 100A.

Whether the label 103 can be stably conveyed until printing is completed when not using the take-up unit 23 can also be determined by comparing length LA1 and logical label length L1. To convey the label 103 until printing ends, the area of contact between the label 103 and the conveyance belt 52 must equal at least a specific area until the trailing end of the print image 107 reaches the final printing position P4.

In other words, the length from the trailing end of the print image 107 to the trailing end 100A must be equal to or greater than a specific length. Because the size of the largest possible print image 107 is the same size as the printable area 105, the label 103 can be conveyed until printing is completed if the length from the trailing end of the printable area 105 to the trailing end 100A is at least the specific length (condition A).

Therefore, by determining whether or not length LA1 is greater than or equal to logical label length L1 when not using the take-up unit 23, the control unit 10 can also determine if the label 103 has been cut, and if the label 103 can be conveyed until printing is completed.

When using the take-up unit 23, the control unit 10 determines whether or not printing can be completed based on the nipping limit position P6. If printing is completed when the trailing end of the label 103 reaches the final printing position P4, the control unit 10 uses length LB1 from the final printing position P4 to the trailing end of the label 103 as the conveyance distance until printing ends. For example, the conveyance distance until printing ends on the label 103A located directly below the printhead 40 is length LB1 shown in FIG. 7. As described above, the trailing end of the label 103 in some embodiments of the invention is the position separated logical label length L1 from the leading end of the label 103.

The control unit 10 determines whether or not the label paper 100 can be held by the conveyance roller 55 when the label paper 100 is conveyed length LB1 by comparing length LB1 and distance LC1. This distance LC1 is the length from the printing reference position P3 to the nipping limit position P6, and printing the label 103 can be completed if LB1<=LC1.

If LB1=LC1, the label paper 100 that was at the nipping limit position P6 when the trailing end 100A was detected has reached the final printing position P4. The length of label paper 100 remaining upstream of the final printing position P4 at this time is the distance between the nipping limit position P6 and detection position P1 in FIG. 7. In other words, the nipping limit position P6 is the position that defines the length of the label paper 100 left upstream from the final printing position P4 when printing ends.

If LB1<=LC1, a sufficient length of label paper 100 remains when printing ends, stable conveyance is therefore possible, and printing can be completed.

If LB1>LC1, the length of label paper 100 left when printing ends is not sufficient, and printing cannot be completed.

By obtaining length LB1 for each label 103 and comparing this length LB1 with distance LC1, the control unit 10 can determine whether or not printing each label 103 is possible. In the example shown in FIG. 7, LB1<=LC1 for label 103A, and printing can be completed. However, because length LB1 of labels 103B to 103D in FIG. 7 is greater than distance LC1, labels 103B to 103D cannot be completely printed. This decision can be made regardless of the logical label length L1 of the labels 103.

Figure 8:
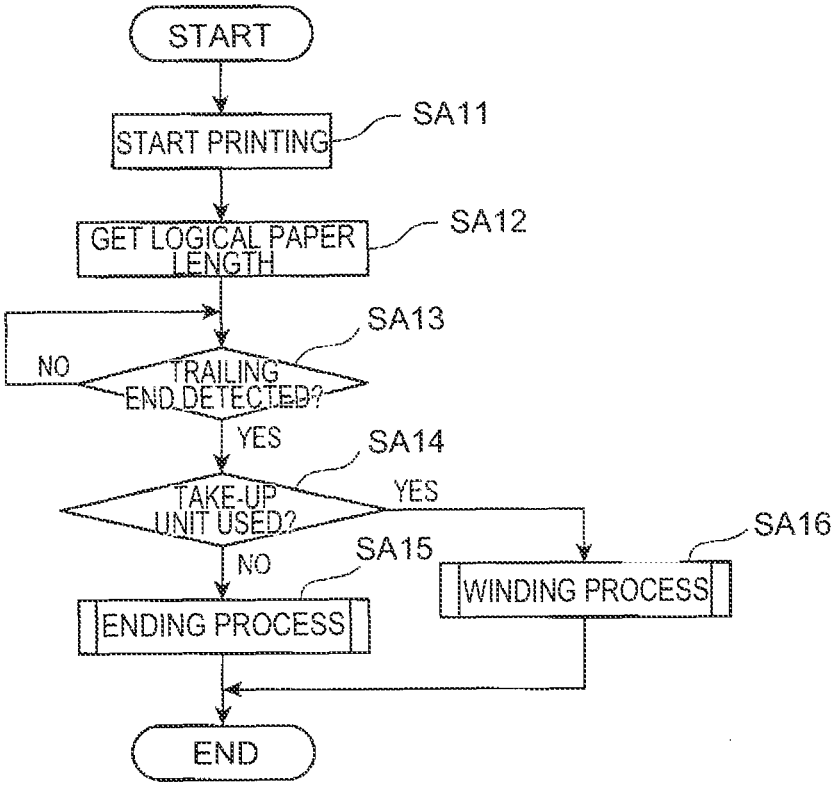
FIG. 8 is a flow chart illustrating the operation of the printer.
Figure 9:
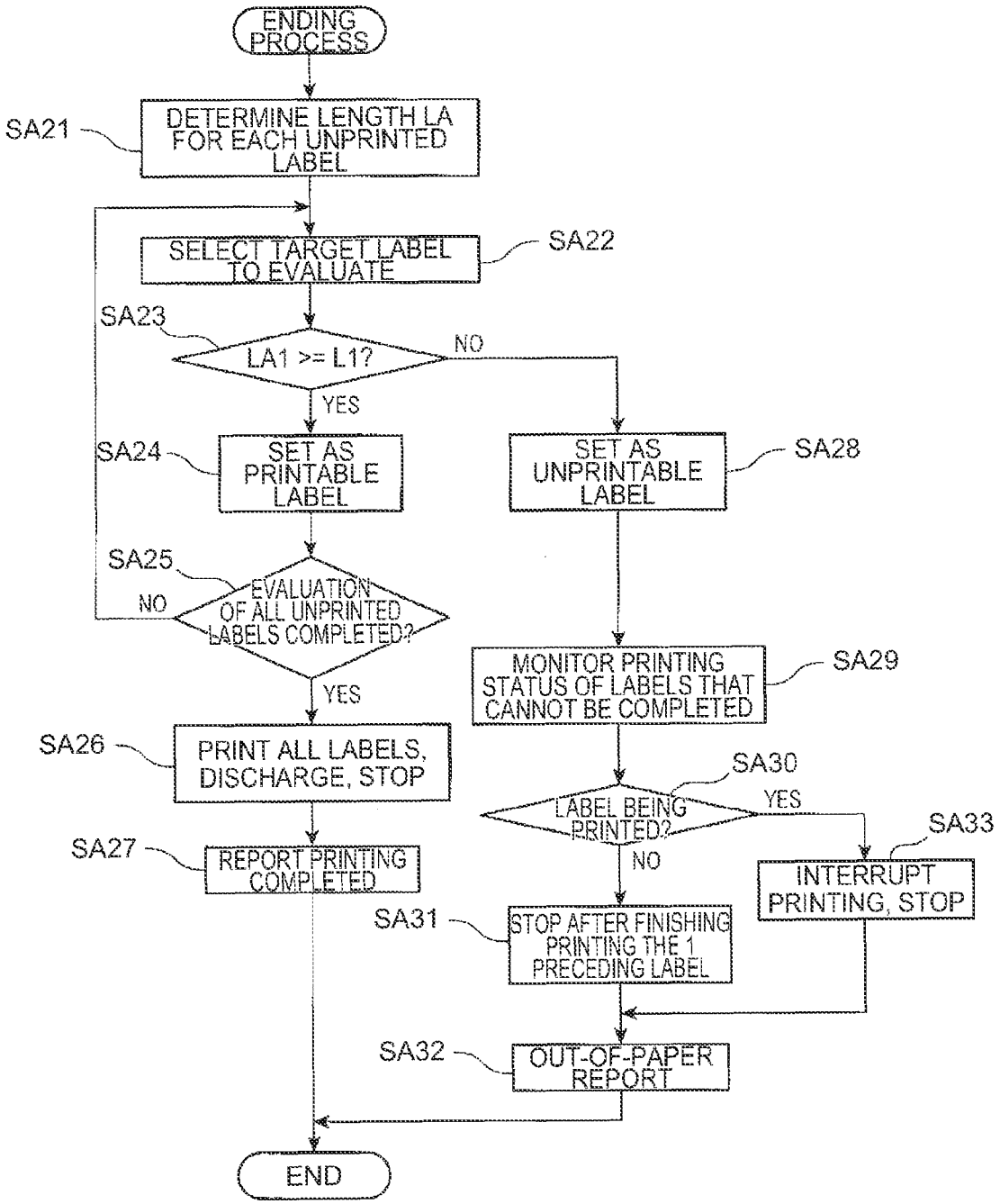
FIG. 9 is a flow chart illustrating the operation of the end-of-media process of the printer.
Figure 10:
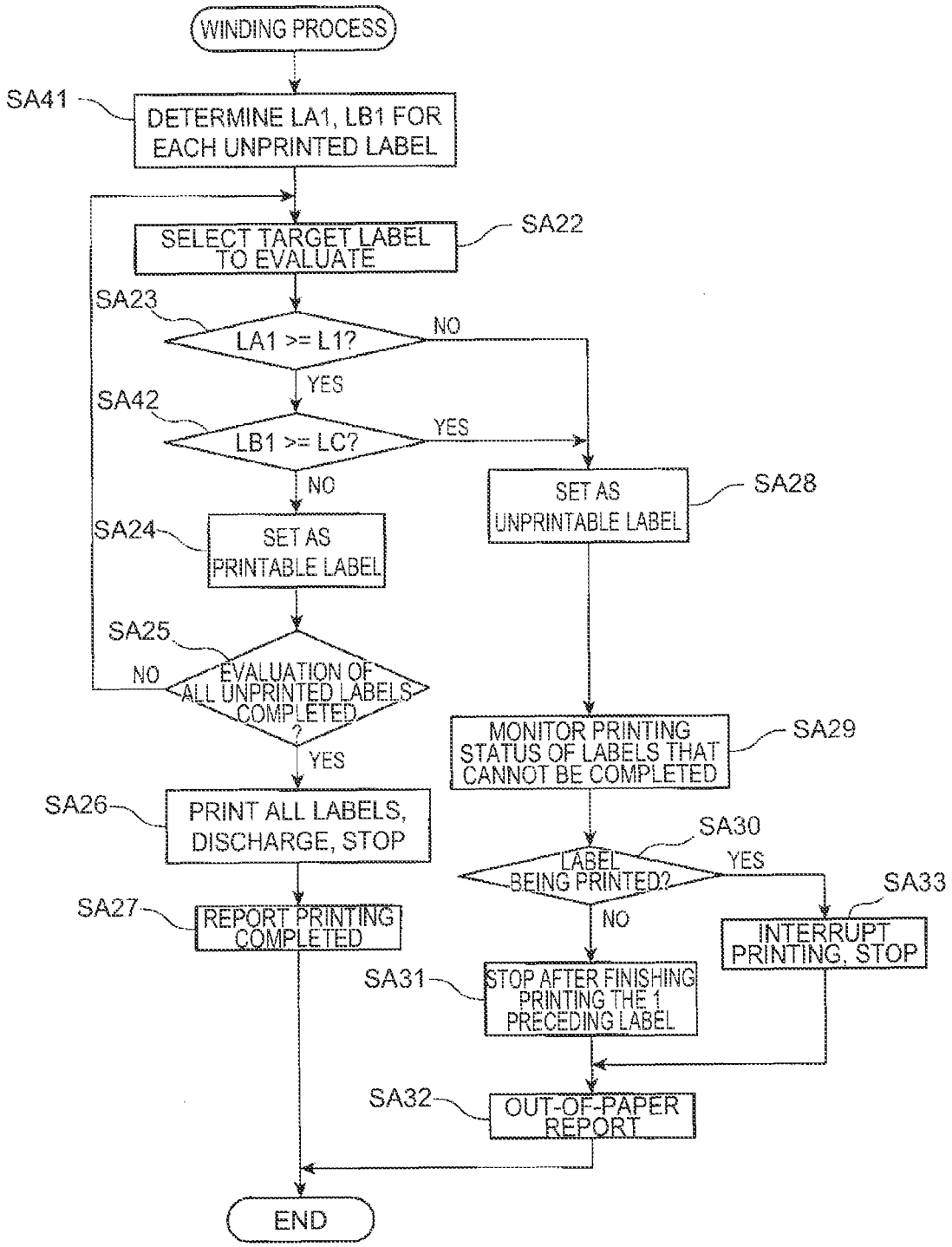
FIG. 10 is a flow chart illustrating the operation of the rewind handling process of the printer.

FIG. 8 to FIG. 10 are flow charts describing the operation of the printer 1.

The control unit 10 first receives print commands and print data from the host computer 5 and starts the printing operation (step SA11), and then acquires the logical label length L1 of the label paper 100 in the print media storage compartment 21 from the storage unit 12 or ROM before starting to print (step SA12).

The control unit 10 then starts printing and monitors whether or not the trailing end 100A is detected by the paper detector 61 while printing (step SA13). The control unit 10 continues printing if the trailing end 100A is not detected (step SA13 returns NO).

When the trailing end 100A is detected (step SA13 returns YES), the control unit 10 determines if the take-up unit 23 is being used (step SA14). In this example, the printer 1 is configured so that the control unit 10 can determine if the take-up unit 23 is used. For example, using the take-up unit 23 can be turned on/off by sending a command from the host computer 5 to the printer 1. A sensor that operates mechanically when the take-up unit 23 is installed could also be disposed to a position at the front of the printer 1 where the take-up unit 23 is installed, and the presence of the take-up unit 23 may be detected based on the output of this sensor.

If the take-up unit 23 is not being used (step SA14 returns NO), the control unit 10 controls printing based on the position of the trailing end 100A in the end-of-media process described below (step SA15), and then stops operation.

If the take-up unit 23 is being used (step SA14 returns YES), the control unit 10 executes the rewind handling process described below (step SA16), controls printing based on the position of the trailing end 100A, and then stops operation.

FIG. 9 is a flow chart describing operation related to the end-of-media process in step SA15 in FIG. 8.

Of the labels 103 on the label paper 100, the control unit 10 identifies the labels 103 for which printing is not completed, that is, the labels 103 between the final printing position P4 and the trailing end 100A, and obtains length LA1 for each label 103 (step SA21).

Next, the control unit 10 selects one target label 103 for evaluation from the group of identified labels 103 (step SA22). In step SA22, the control unit 10 sequentially selects the labels 103 that have not been processed by the end-of-media process shown in FIG. 9 from the group of labels 103 that were identified in step SA21, starting from the label 103 farthest from the trailing end 100A. More simply, the control unit 10 sequentially selects the labels 103 starting from the label 103 that will be printed first.

The control unit 10 then compares the length LA1 of the target label 103 with the logical label length L1, and determines if length LA1 is greater than or equal to logical label length L1 (step SA23). If length LA1 is greater than or equal to logical label length L1 (step SA23 returns YES), the control unit 10 sets the target label 103 as a label that can be completely printed (step SA24).

The control unit 10 then determines whether or not all labels 103 identified in step SA21 have been evaluated as the target label in step SA23 (step SA25). If all labels 103 have not been evaluated (step SA25 returns NO), the control unit 10 returns to step SA22 and selects the next label 103 as the target label.

If all labels 103 have been evaluated (step SA25 returns YES), then all labels 103 have been determined to be printable to the end. In this event, the control unit 10 continues printing and prints on all labels 103 (step SA26), then reports to the host computer 5 that printing ended (step SA27), and ends this process.

However, if length LA1 is shorter than logical label length L1 (step SA23 returns NO), the control unit 10 sets the target label 103 as a label that cannot be completely printed (is unprintable) (step SA28). The control unit 10 then starts monitoring the print status of the label 103 determined to be a label that cannot be completely printed (unprintable) (step SA29).

The control unit 10 determines if the monitored label 103 is already being printed by the printhead 40 (step SA30). If it is not being printed (step SA30 returns NO), the control unit 10 stops printing after printing the one label 103 preceding the label 103 being monitored (step SA31).

If printing is stopped in step SA31, the control unit 10 may stop operation of the printhead 40 and then stop conveyance of the label paper 100, or stop conveyance after discharging the label paper 100 to the trailing end 100A.

Next, the control unit 10 tells the host computer 5 that the paper ran out (step SA32), and ends this process.

If a label 103 is set as a label that cannot be completely printed and the printing status of that label 103 is then determined to be being printed by the printhead 40 (step SA30 returns YES), the control unit 10 interrupts printing and stops the printing operation (step SA33). In step SA33, the control unit 10 stops ejecting ink from the printhead 40 even if printing a print image 107 is inprogress. Conveyance of the label paper 100 may then also be stopped, or conveyance may be stopped after discharging the label paper 100 to the trailing end 100A. The control unit 10 then goes to step SA32 and reports that the paper has run out.

FIG. 10 is a flow chart showing operation during the rewind handling process in step SA16 in FIG. 8. Steps that are the same in the process shown in FIG. 10 and the end-of-media process shown in FIG. 9 are labelled with the same step numbers, and further description thereof is omitted.

Of the labels 103 on the label paper 100, the control unit 10 identifies the labels 103 for which printing is not completed, that is, the labels 103 between the final printing position P4 and the trailing end 100A, and obtains lengths LA1 and LB1 for each label 103 (step SA41).

Next, the control unit 10 selects one target label 103 for evaluation from the group of identified labels 103 (step SA22). The process of step SA22 is as described above.

The control unit 10 then compares the length LA1 of the target label 103 with the logical label length L1, and determines if length LA1 is greater than or equal to logical label length L1 (step SA23). If length LA1 is greater than or equal to logical label length L1 (step SA23 returns YES), the control unit 10 compares the length LB1 of the target label 103 with the distance LC1 used to determine if the target label 103 can be completely printed, and determines if length LB1 is greater than or equal to distance LC1 (step SA42).

If length LB1 is greater than or equal to distance LC1 (step SA42 returns YES), the control unit 10 sets the target label 103 as a label that can be completely printed (step SA24).

The control unit 10 then determines whether or not all labels 103 identified in step SA21 have been evaluated as the target label in step SA23 (step SA25). If all labels 103 have not been evaluated (step SA25 returns NO), the control unit 10 returns to step SA22 and selects the next label 103 as the target label.

If all labels 103 have been evaluated (step SA25 returns YES), the control unit 10 goes to step SA26 and step SA27.

However, if the length LA1 is shorter than the logical label length L1 (step SA23 returns NO), and length LB1 is shorter than distance LC1 (step SA42 returns NO), the control unit 10 sets the target label 103 as a label that cannot be completely printed (step SA28). The control unit 10 then goes to steps SA29 to SA33.

Figure 11A:
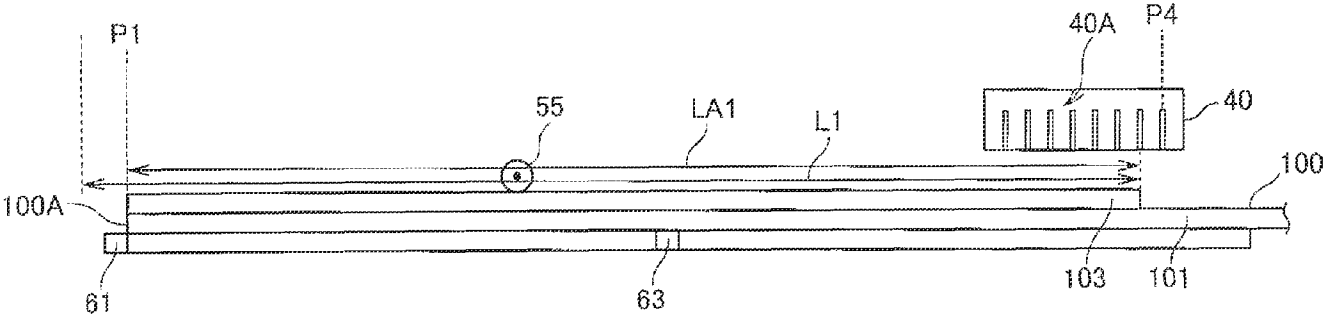
FIGS. 11A, 11B and 11C illustrate a specific example of the operation of the printer.
Figure 11B:
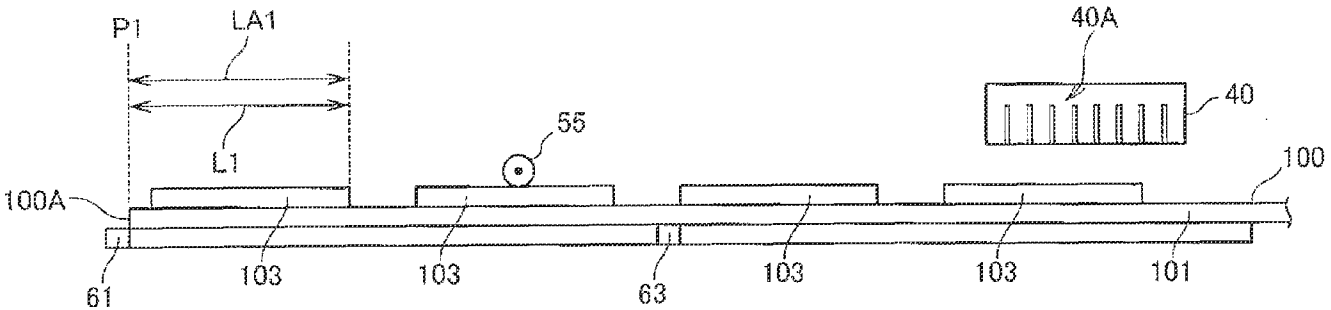
Figure 11C:
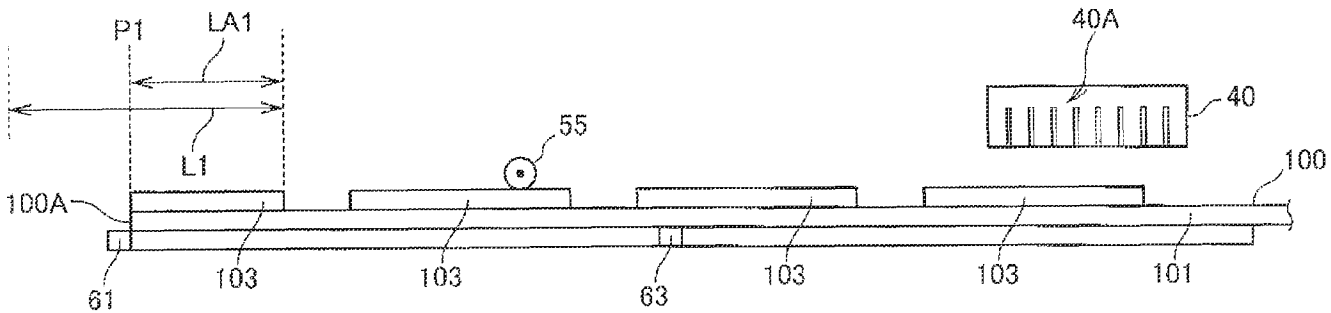
Figure 12:
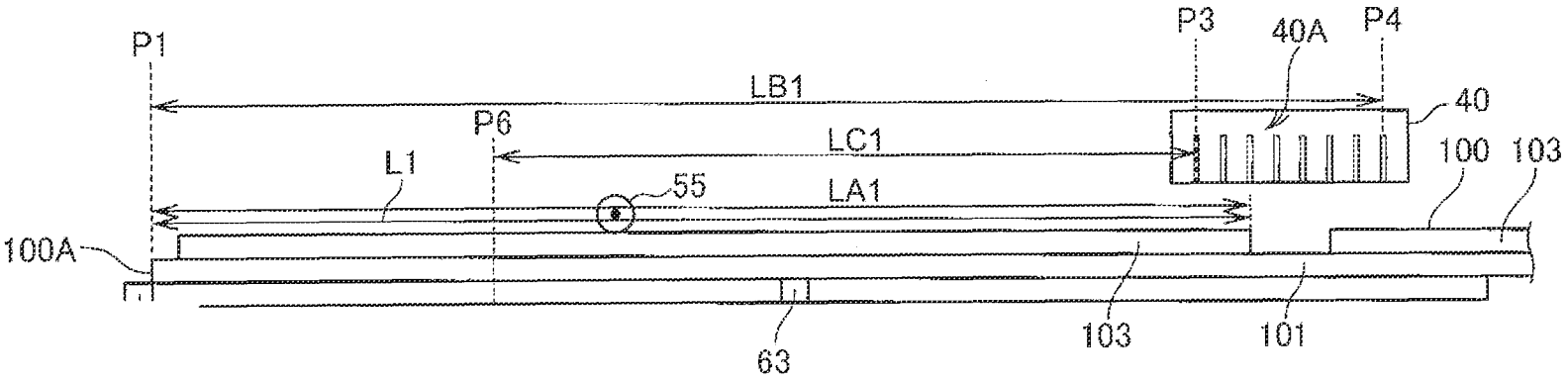
FIG. 12 illustrates a specific example of the operation of the printer.
Figure 13A:
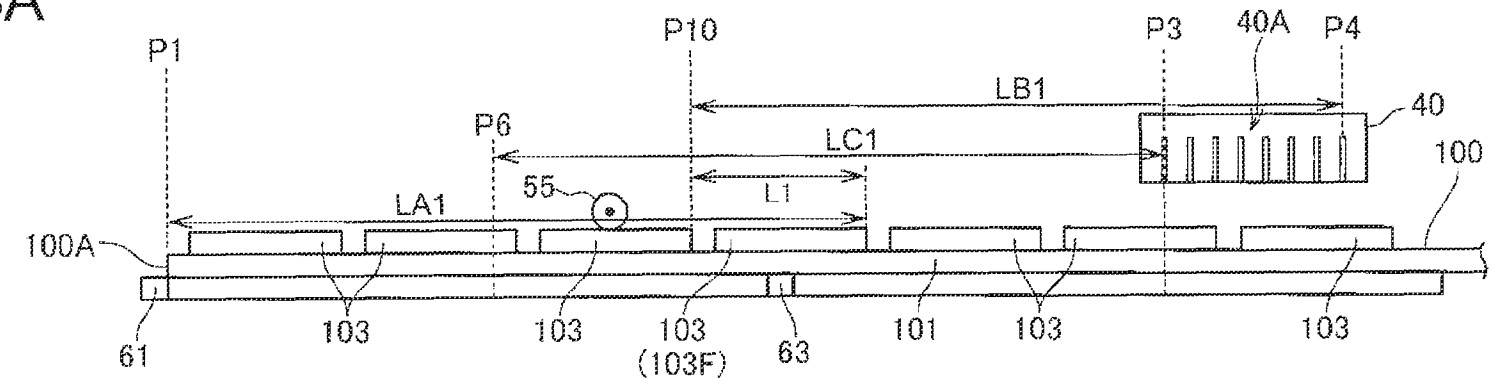
FIGS. 13A and 13B illustrate a specific example of the operation of the printer.
Figure 13B:
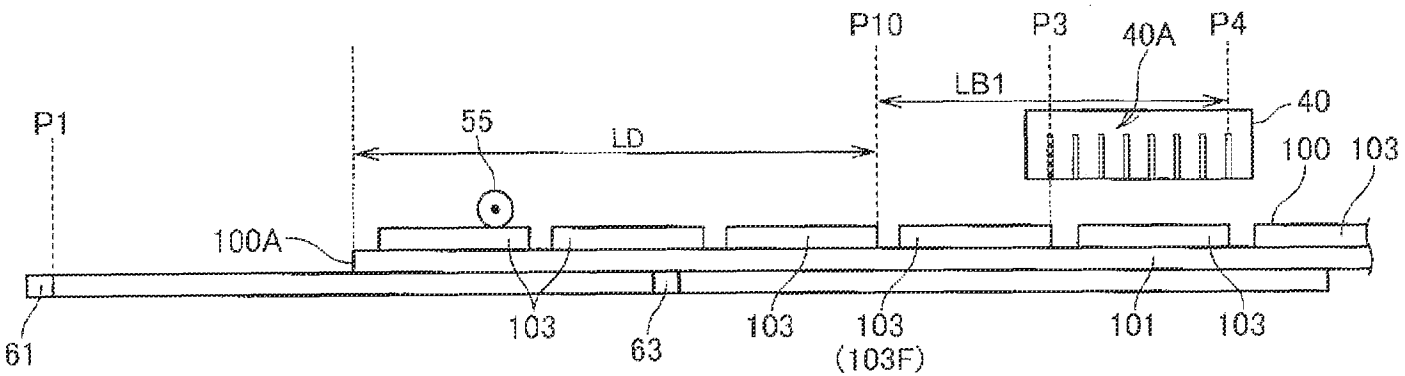

FIG. 11 to FIG. 13 illustrate specific examples of the operation of the printer 1.

FIG. 11 (A) to (C) illustrate operation when not using the take-up unit 23. Operation in these cases is as described with reference to FIG. 5.

In the example shown in FIG. 11 (A), the label paper 100 has been cut off at the trailing end 100A end and the label 103 shortened. Because the length LA1 of the label 103 is shorter than the logical label length L1 in this event, the control unit 10 stops operation without printing on the label 103. If the label 103 is long as shown in the example in FIG. 11 (A), printing at the leading end of the label 103 may have already started before the trailing end 100A is detected by the paper detector 61. In this case, the control unit 10 stops printing quickly after determining that length LA1 is shorter than the logical label length L1. Wasteful consumption of ink can thus be prevented.

In the example shown in FIG. 11 (B), the trailing end of the label paper 100 has not been cut off and length LA1 is equal to logical label length L1. In this event, printing all of the labels 103 can be completed, and the control unit 10 therefore stops operation after printing the last label 103 on the label paper 100.

In the example shown in FIG. 11 (C), the trailing end 100A of the label paper 100 has been cut off similarly to the example shown in FIG. 11 (A), but all labels 103 other than the label 103 closest to the trailing end 100A can be printed. In this case, the control unit 10 stops operation after printing the labels 103 other than the label 103 closest to the trailing end 100A.

FIG. 12 and FIGS. 13 (A) and (B) illustrate examples of operation when using the take-up unit 23. Operation in these cases is as described with reference to FIG. 6.

In the example shown in FIG. 12, length LA1 of the label 103 closest to the trailing end 100A is equal to logical label length L1, and length LB1 is greater than distance LC1. When the logical label length L1 of the label 103 is long as shown in the example in FIG. 12, length LB1 can easily become greater than distance LC1. In this event, the control unit 10 determines that the label 103 closest to the trailing end 100A is a label that cannot be completely printed, and stops the printing operation of the printer 1 after finishing printing the label 103 therebefore, by means of the process shown in FIG. 10.

In the example shown in FIG. 13 (A), the labels 103 are short, and plural labels 103 are on the upstream side of the printhead 40 when the trailing end 100A is detected by the paper detector 61. More specifically, because there are plural labels 103 that have not been printed, the control unit 10 identifies all unprinted labels 103 and determines if they can be printed. In this example, the length LA1 of the fourth label 103F from the trailing end 100A is greater than the logical label length L1, and length LB1 is greater than distance LC1. As a result, label 103F is determined to be a label that cannot be printed completely.

FIG. 13 (B) shows the label paper 100 advanced from the position in FIG. 13 (A) and the label 103 before label 103F being printed. In order to completely print label 103F, the trailing end of the label 103 must be conveyed to the final printing position P4 from the position shown in FIG. 13 (B). However, as will be clear from FIG. 13 (B), because the length of the label paper 100 on the upstream side of label 103F is short, the conveyance roller 55 cannot hold the label paper 100 to the completion of printing to label 103F. Printing the label 103 on the downstream side of label 103F, however, can be completed.

The control unit 10 therefore stops the printing operation before starting to print label 103F. Because the control unit 10 does not determine if printing the plural labels 103 located upstream from label 103F can be completed in this event, printing can be stopped quickly.

As described above, the printer 1 according to this embodiment has a conveyance unit (conveyance mechanism) that conveys label paper 100 with labels 103 as the print media. The printer 1 also has a printhead 40 disposed to the conveyance path of the label paper 100, and a paper detector 61 and label detector 63 that detect at plural detection positions on the conveyance path. When the trailing end 100A of the label paper 100 is detected by the control unit 10, the printer 1 determines whether or not printing a label 103 can be completed based on the detection results of the paper detector 61 and label detector 63. The printer 1 also stops printing by the printhead 40 when it is determined that printing cannot be completed, or conveys the label paper 100 without printing on a label 103. Unnecessary printing can therefore be stopped, or printing can be avoided, when printing a label 103 cannot be completed, and wasting the ink and other consumables and time required for printing can be eliminated.

Multiple labels 103 of a specific length are affixed to the label paper 100 in the conveyance direction F. When the control unit 10 detects the trailing end 100A based on the detection results from the paper detector 61 and label detector 63, the control unit 10 determines if printing the labels 103 can be completed based on the detection results from the paper detector 61 and label detector 63. As a result, when there is a label 103 in the group of labels 103 disposed along the conveyance direction F that cannot be completely printed, printing unnecessarily to that label 103 stops or printing does not start, and wasting the ink and other consumables and time required for printing can be omitted.

Because the control unit 10 determines at least whether or not printing the label 103 closest to the trailing end of the label paper 100 can be completed, wasting the ink and other consumables and time required for printing can be prevented.

The control unit 10 can also determine if printing can be completed by determining based on the position of the trailing end 100A detected by the paper detector 61 whether or not the label paper 100 can be conveyed to the completion of printing the label 103. Whether or not printing can be completed can therefore be appropriately determined, and unnecessary printing operations can be prevented.

Because the paper detector 61 and label detector 63 detect the label paper 100 upstream from the printhead 40 at different positions in the conveyance direction F of the label paper 100, whether or not printing on a label 103 can be completed can be determined more appropriately. The label detector 63 also detects the leading end of a label 103, and the control unit 10 determines the position of the leading end of the label 103 based on the detection result from the label detector 63. The control unit 10 then determines whether or not printing can be completed based on the identified position of the leading end of the label 103 and the length of the label 103 in the conveyance direction F. As a result, the position of the label 103 can be accurately determined, and whether or not printing on the label 103 can be completed can be determined more appropriately.

Some embodiments of invention are described above with reference to a preferred embodiment thereof, but some embodiments of invention are not limited thereto and can be modified and adapted in many ways without departing from the scope of the accompanying claims.

For example, the foregoing embodiment describes detecting the leading end of a label 103 by means of a label detector 63 disposed to the conveyance path 110. Some embodiments of invention are not so limited, however, and the label detector 63 may be used to detect black marks on the label paper 100, or a photosensor for detecting black marks could be disposed separately from the label detector 63. Black marks are marks that are black or other color denoting the positions of labels 103 on the label paper 100, and may be formed on the front side or the back side of the label paper 100. The label detector 63 or additional photosensor may be disposed above or below the conveyance path 110 at a position appropriate to the location of the black marks.

A take-up unit 23 is also described as an example of a recovery device for recovering the label paper 100 printed by the printer 1, but the recovery device must only be able to recover the label paper 100 discharged from the paper exit 22 of the printer 1, and can be configured as desired. For example, a recovery device having a roller that holds the label paper 100 outside the paper exit 22, and a storage unit that stores the label paper 100 in a folded stack or rolled form, may be used.

The foregoing embodiment describes a configuration in which the printer 1 prints based on print data received from a host computer 5, but the printer 1 may be a stand-alone printer that prints stored image data or text data. The foregoing embodiment also uses an inkjet printer by way of example, but the specific configuration of the printer 1 is not so limited and some embodiments of invention can also be applied to dot impact printers, thermal printers, and laser printers, for example. The function blocks shown in FIG. 1 can also be rendered as desired by the cooperation of hardware and software, and do not suggest a specific hardware configuration. The control unit 10 can also execute the operations described above by running a program stored on a storage medium externally connected to the printer 1.

The disclosure being thus described, it will be obvious that it may be varied in many ways. Such variations are not to be regarded as a departure from the spirit and scope of the disclosure, and all such modifications as would be apparent to one skilled in the art are intended to be included within the scope of the following claims.

What is claimed is:

1. A printer comprising:

a conveyance mechanism that conveys a print medium having a print target;

a printhead disposed to the conveyance path of the print medium;

a paper detector that detects a trailing end of the print medium, the paper detector being disposed upstream of the printhead on the conveyance path;

a label detector that detects the print target, the label detector being disposed upstream of the printhead and downstream of the paper detector on the conveyance path;

a control unit that identifies the position of the trailing end of the print medium when the trailing end of the print medium is detected by the paper detector; wherein the control unit determines if printing on the print target detected by the label detector can be completed based on the identified position of the trailing end of the print medium, and if printing cannot be completed, stops the printhead from printing on the print target.

2. The printer described in claim 1, wherein:

a plurality of print targets of a specific length are disposed to the print medium in the conveyance direction; and the control unit does not determine the printability of a print target on the upstream side of the print target determined to be not completely printable.

3. The printer described in claim 1, wherein:

in the process of determining if printing on the print target can be completed, the control unit determines based on the position of the trailing end of the print target detected by the paper detector if conveyance of the print medium is possible until printing on the print target is completed.

4. The printer described in claim 3, wherein:

the control unit decides based on a setting of the remaining length of the print medium required to convey the print medium until printing on the print target is completed.

5. The printer described in claim 4, wherein:

a recovery device that recovers the print medium after printing can be installed downstream from the printhead on the conveyance path; and the control unit decides based on the setting of the remaining length of print medium corresponding to whether or not the recovery device is installed.

6. The printer described in claim 1, wherein:

a plurality of print targets of a specific length are disposed to the print medium in the conveyance direction; and the control unit determines whether or not printing on the print target can be completed based on the detection result from the paper detector when the trailing end of the print medium is detected based on the detection result from the label detector.

7. The printer described in claim 6, wherein:

the control unit determines at least whether or not printing can be completed on the print target closest to the trailing end of the print medium.

8. The printer described in claim 6, wherein:

the control unit determines whether or not printing can be completed by determining based on the position of the trailing end of the print medium detected by the paper detector whether or not the print medium can be conveyed until printing the print target is completed.

9. The printer described in claim 6, wherein:

the label detector detects a mark indicating the leading end of the print target or the position of the print target; and the control unit identifies the position of the leading end of the print target based on the detection result from the label detector, and determines if printing can be completed based on the position of the leading end of the identified print target and the length of the print target in the conveyance direction.

10. A control method of a printer having a conveyance mechanism that conveys a print medium having a print target on a conveyance path, a printhead disposed to the conveyance path of the print medium, a paper detector disposed upstream of the printhead on the conveyance path, and a label detector disposed upstream of the printhead and downstream of the label detector on the conveyance path, the control method comprising:

determining if printing on the print target detected by the label detector can be completed when the trailing end of the print medium is detected by the paper detector, and if printing cannot be completed, stopping printing by the printhead on the print target.

* * * * *